US006634873B2

(12) United States Patent
Klassen

(10) Patent No.: US 6,634,873 B2
(45) Date of Patent: Oct. 21, 2003

(54) METHOD FOR DETERMINING ENGAGEMENT SURFACE CONTOURS FOR A ROTOR OF AN ENGINE

(75) Inventor: James B. Klassen, Lynden, WA (US)

(73) Assignee: Outland Technologies, Inc., Calgary (CA)

( * ) Notice: Subject to any disclaimer, the term of this patent is extended or adjusted under 35 U.S.C. 154(b) by 40 days.

(21) Appl. No.: 09/862,246

(22) Filed: May 22, 2001

(65) Prior Publication Data

US 2002/0094293 A1 Jul. 18, 2002

Related U.S. Application Data

(63) Continuation of application No. 09/318,572, filed on May 26, 1999, which is a continuation-in-part of application No. 09/085,139, filed on May 26, 1998, now Pat. No. 6,036,463, which is a continuation of application No. 08/401,264, filed on Mar. 9, 1995.

(60) Provisional application No. 60/086,838, filed on May 26, 1998, now Pat. No. 5,755,196.

(51) Int. Cl.[7] ..... F01C 3/06

(52) U.S. Cl. ..... 418/1; 418/195

(58) Field of Search ..... 123/241; 418/68, 418/195, 1

(56) References Cited

U.S. PATENT DOCUMENTS

| | | | | | |
|---|---|---|---|---|---|
| 32,372 | A | * | 5/1861 | Jones et al. | 418/195 |
| 351,129 | A | * | 10/1886 | Salomo | 418/195 |
| 2,101,051 | A | * | 12/1937 | Cuny | 418/195 |
| 2,101,428 | A | * | 12/1937 | Cuny | 418/195 |
| 2,242,058 | A | * | 5/1941 | Cuny | 418/195 |
| 3,101,700 | A | * | 8/1963 | Bowdish | 418/195 |
| 3,106,912 | A | * | 10/1963 | Kahlert | 418/195 |
| 3,156,222 | A | * | 11/1964 | Miller | 123/241 |
| 3,236,186 | A | * | 2/1966 | Wildhaber | 418/195 |
| 3,816,038 | A | * | 6/1974 | Berry | 418/68 |
| 3,856,440 | A | * | 12/1974 | Wildhaber | 418/195 |

FOREIGN PATENT DOCUMENTS

| | | | | |
|---|---|---|---|---|
| CA | 2069607 | * | 11/1993 | 418/195 |
| DE | 1551081 | * | 4/1970 | |
| DE | 2639760 | * | 3/1978 | |
| DE | 3221994 | * | 12/1983 | 418/195 |
| FR | 916277 | * | 8/1946 | 418/195 |
| GB | 805370 | * | 12/1958 | |
| GB | 1099085 | * | 1/1968 | |
| IT | 268459 | * | 10/1929 | 418/195 |
| JP | 55-72683 | * | 5/1980 | 418/195 |

* cited by examiner

*Primary Examiner*—Michael Koczo
(74) *Attorney, Agent, or Firm*—Michael F. Hughes; Hughes Law Firm, PLLC

(57) ABSTRACT

An improved rotary engine and method for determining the contours of the sealing surfaces thereof. The improved engine provides for maintaining a predetermined, optimal gap between the sealing surfaces during rotation. The gap may be parallel or angled, and may be positive or negative so as to form an interference engagement. The rotors of the engine may be provided with mirror-image sealing surfaces so as to prevent development of excessive back-lash and clearance, and also to permit efficient reverse operation. The sealing surfaces may also be provided with recesses for interrupting the seal at predetermined points in the rotational cycle, for enhanced wear characteristics and/or to accommodate abrasive or shear-sensitive fluids.

15 Claims, 21 Drawing Sheets

FIG. 15E
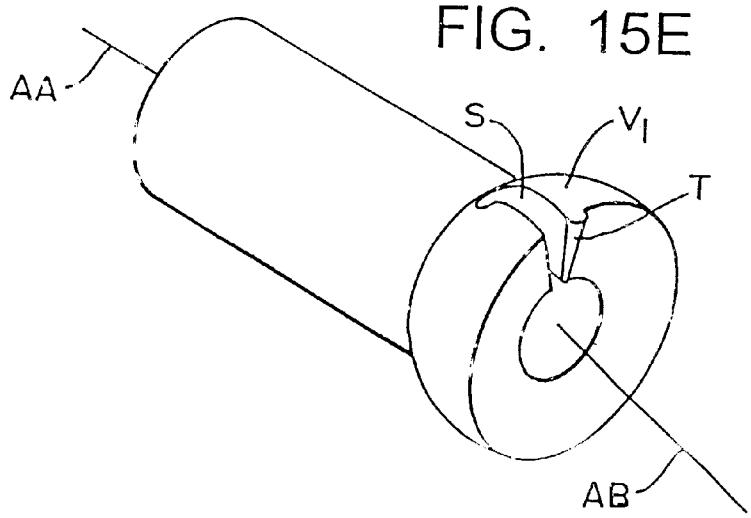
FIG. 15F
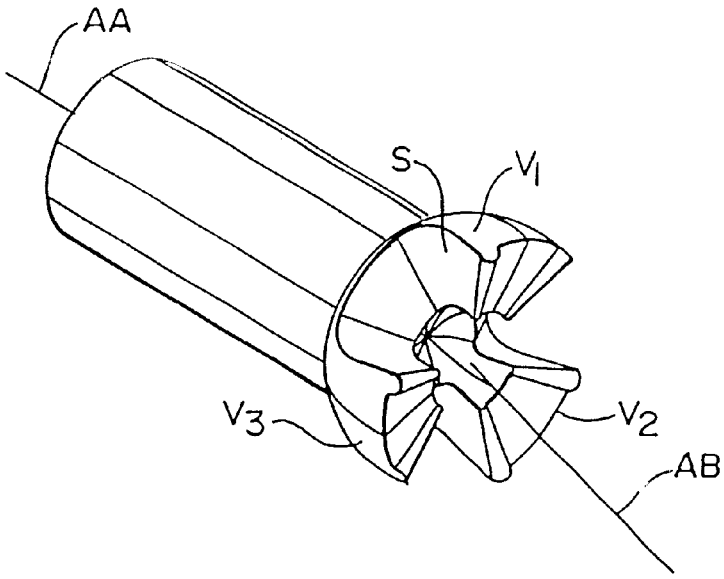
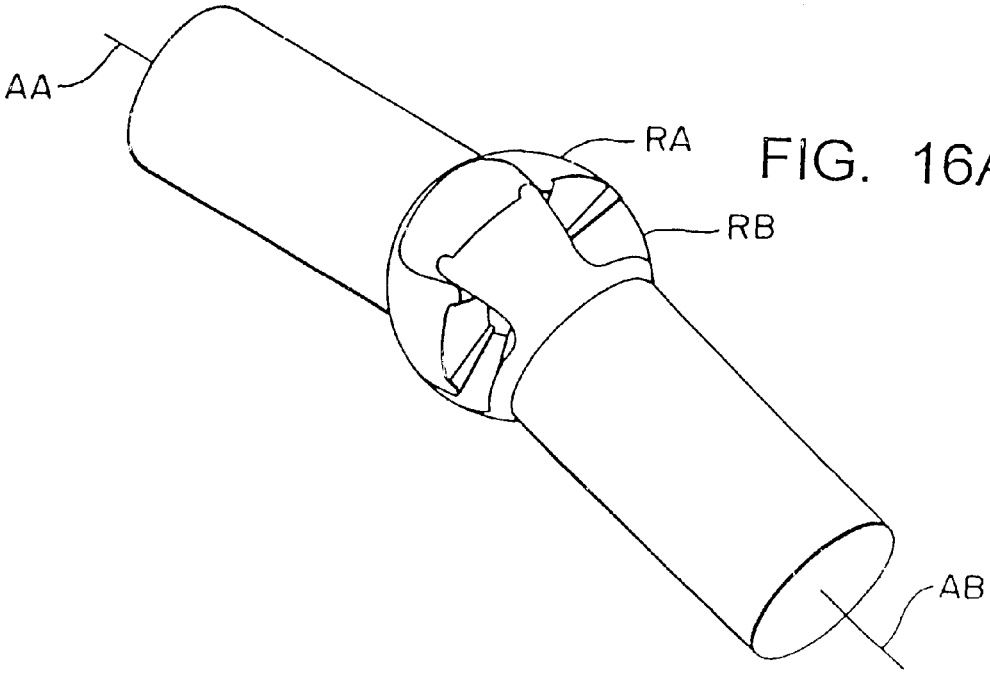
FIG. 16A

SEAL SURFACE ROTATION
RELATIVE TO OTHER SURFACES

METHOD FOR DETERMINING ENGAGEMENT SURFACE CONTOURS FOR A ROTOR OF AN ENGINE

RELATED APPLICATIONS

This application claims priority of U.S. Provisional Application Ser. No. 60/086,838, which was filed May 26, 1998 and is a continuation of Ser. No. 09/318,572 filed May 26, 1999 that was a continuation in part of U.S. application Ser. No. 09/085,139, which was filed May 26, 1998 and now matured into U.S. Pat. No. 6,036,463 which is a continuation of Ser. No. 08/401,264 filed Mar. 9, 1995 and now issued as U.S. Pat. No. 5,755,196.

FIELD OF THE INVENTION

The present invention relates to rotary positive displacement engines and to methods for determining engagement surface contours for use in the making of rotary positive displacement engines.

BACKGROUND

This invention concerns an advanced rotary positive displacement engine having high power to mass ratio and low production cost. The term "engine" as used in this patent document is taken to be a device that converts one form of energy into another. Hence, the term includes both devices which impart energy to the fluid flow (e.g. a pump) and those which employ the fluid flow to generate an energy output (e.g. an external combustion engine for providing a power source).

In the case of prior art combustion engines, the reciprocating piston type is most widely used for its low cost of production and efficient sealing, while the turbine has shown that an external combustion engine may offer greater power, partially from high speed. Rotary engines such as the Wankel engine have shown higher power-to-weight ratios than reciprocating engines but at the expense of increased fuel consumption. The present invention is a rotary device that offers many of the advantages of these prior art devices without many of their shortcomings.

In the case of pumps, there are many general types of pump designs known, such as positive displacement, centrifugal and impeller. Pumps of the positive displacement type are typically reciprocating or rotary. Many previous rotary combustion engine designs in turn, have been of the single plane type in which rotary motion occurs about axes that are parallel to each other.

Prior forms of rotary pumps and combustion engines have been limited in their efficiency, in part by inherent limitations in their operating principles, and also in many instances by their inability to establish a seal between operating surfaces which is sufficient to achieve a high degree of efficiency, yet which also accommodates the physical characteristics of the fluid which much pass therethrough.

Many of the deficiencies of prior types of rotary pumps and engines have been negated by a positive displacement engine which has been developed by Applicant (referred to from time to time herein as a "CvR Engine") and, which is disclosed in issued U.S. Pat. No. 5,755,196, the entirety of which is hereby incorporated by reference herein. The present invention, however, provides several significant improvements and advances which are applicable to the CvR engine design which is disclosed in U.S. Pat. No. 5,755,196.

For example, as the demand for higher performance and higher efficiency are increased, machining techniques have also been improving.

At the same time, however, different applications may require various clearances and interferences between the surfaces not always the closest possible fit. For example, the movement of fluids with suspended particles may require large enough sealing surface clearances to allow these solids to pass through in the fluid film. In some applications, such as irrigation pumping, these particles may be in excess of 0.1". In other applications, such as in the semi-conductor or medical industries, the particle size can be as small as several microns. Hence, there are many applications where it is essential to establish a finite, precisely controlled gap between the two sealing surfaces to provide a positive sealing surface geometry (SSG).

Similarly, where comparativily low tolerance manufacturing techniques are used to produce lower performance or less expensive designs, a sealing surface geometry (SSG) which allows for the inconsistencies of the final surface. Higher tolerance machining techniques will also benefit from a predetermined SSG to maintain a minimum gap clearance or to prevent contact or binding of the mating rotors. Hard coating of a suitable base material also requires a pre coated surface geometry which prevents the coated SSG from binding or interfering.

Some applications may even benefit from an interfering or "negative" SSG. Compressible or deformable materials and coatings can provide increased seal performance if they are designed to interfere with the mating surface on the opposite rotor. This can be accomplished by applying such a coating over a harder base material having a negative SSG to bring the surface back to a reduced negative SSG, so as or a positive SSG.

Another advantage made possible by an extremely precise SSG is the espablishment of a fluid fild bearing between the sealing surfaces. Fluid film bearings have been used successfully in industry to replace ball bearings or plain bearings in many applications. Fluid films for bearings range from several ten thousandths of an inch to several thousandths of an inch. Having a fluid film between the sealing surfaces of the engine rotors will decrease friction and wear, however, establishing this fluid film requires a correctly designed surface interface. If the surface interface has a gap space which does not account for the other variables which affect the fluid film; however, extra friction and wear, as well as volumetric efficiency compromises, may result.

An excessive clearance or gap between the sealing surface, may lead to excessive leak-by, thereby significantly impairing the overall efficiency of the engine. For example, if excessive "backlash" develops between the sealing surfaces of the CvR™-type engine described above, this can result in undesirable amounts of leak-by.

An additional concern is that for many applications it is desirable for the engine to be highly efficient in both forward and reverse directions of operation. Consequently, if the sealing surfaces of the engine are able to move apart and create an excessive back-lash, due to deficiencies in the desired SSG or for other reasons the engine will be unsatisfactory for reverse operation.

Accordingly, there exists a need for a method for determining the contours of the sealing surfaces of a rotary engine (as defined herein) so that these will have a precise, controlled gap during operation of the pump. Furthermore, for manufacturing purposes, there exists a need for a method for verifying that the correct contours have been imparted to such surfaces. Still further, there exists a need for an engine having such surfaces arranged so that the proper gap will be maintained during both forward and reverse operation.

SUMMARY OF THE INVENTION

The present invention is of the rotary positive displacement type, but is in a class by itself. This rotary positive displacement device is believed to be the first rotary engine in which the axes of the moving parts are offset from each other and the moving parts rotate at a constant velocity relative to each other when they are rotating at a constant velocity relative to the casing. The engine is formed by a pair of facing rotors that are axially offset from one another and whose faces define chambers that change volume with rotation of the rotors.

An engine of this type defines a new class of engines, and includes a minimum number of moving parts, namely as few as two in total.

In one aspect of the invention, a pump includes a pair of rotors, both housed on and preferably within the same housing. The housing has an interior cavity having a center. Each rotor is mounted on an axis that passes through the center of the cavity, the respective axes of the rotors being at an angle to each other, with the center of each rotor being at the center of the cavity. The rotors interlock with each other to define chambers. Vanes defined by a contact face on one side of the vane and a side face on the other side of the vane protrude from the rotors. The contact faces of the rotors are defined so that there is constant linear contact between opposing vanes on the two rotors as they rotate. The side faces are preferably concave and extend from an inner end of one contact fact to the outer end of an adjacent contact face, equivalent to the tip of a vane. The side faces and contact faces define walls of chambers that change volume as the rotors rotate. Ports for intake and exhaust are preferably configured to have shapes complementary to the intersecting vanes of the rotors.

Also in accordance with the present invention, a method is provided for determining a precise, controllable gap between the sealing surfaces on the rotors. These methods include both mathematical and geometric processes, a well as methods for verifying that the correct contours have been imparted to the surfaces.

Still further, in accordance with a preferred embodiment of the invention, the vanes on the rotors are provided with mirror-image contoured sealing surfaces which both maintain the desired gap during operation by reducing back-lash, and which also permit efficient reverse operation of the engine.

These and other aspects of the invention will be described in more detail in what follows and claimed in the claims appearing at the end of this document.

BRIEF DESCRIPTION OF THE DRAWINGS

FIGS. 15A–15F are a series of perspective, somewhat schematic views illustrating the manner in which the contoured contact surfaces on the rotor are formed in accordance with the method of FIG. 14, with the movements of the hypothetical cone corresponding somewhat to those of a tool for machining the surfaces;

FIGS. 16A–16B are perspective, somewhat schematic views showing a first rotor, formed as shown in FIGS. 15A–15F, in predetermined angular engagement with a second rotor having corresponding engagement surfaces, showing the sealing surface gap which is formed by the offset between the two sets of surfaces;

DETAILED DESCRIPTION a. Overview

In discussing the rotors used in the engines described herein, reference will be made to "top" and "bottom". Points on a line bisecting the larger angle formed between offset intersecting axes A and B in the plane defined by axes A and B will be referred to as being at the "top", while points on the extension of that line bisecting the acute angle between axes A and B will be referred to as being at the "bottom".

Figure 1:
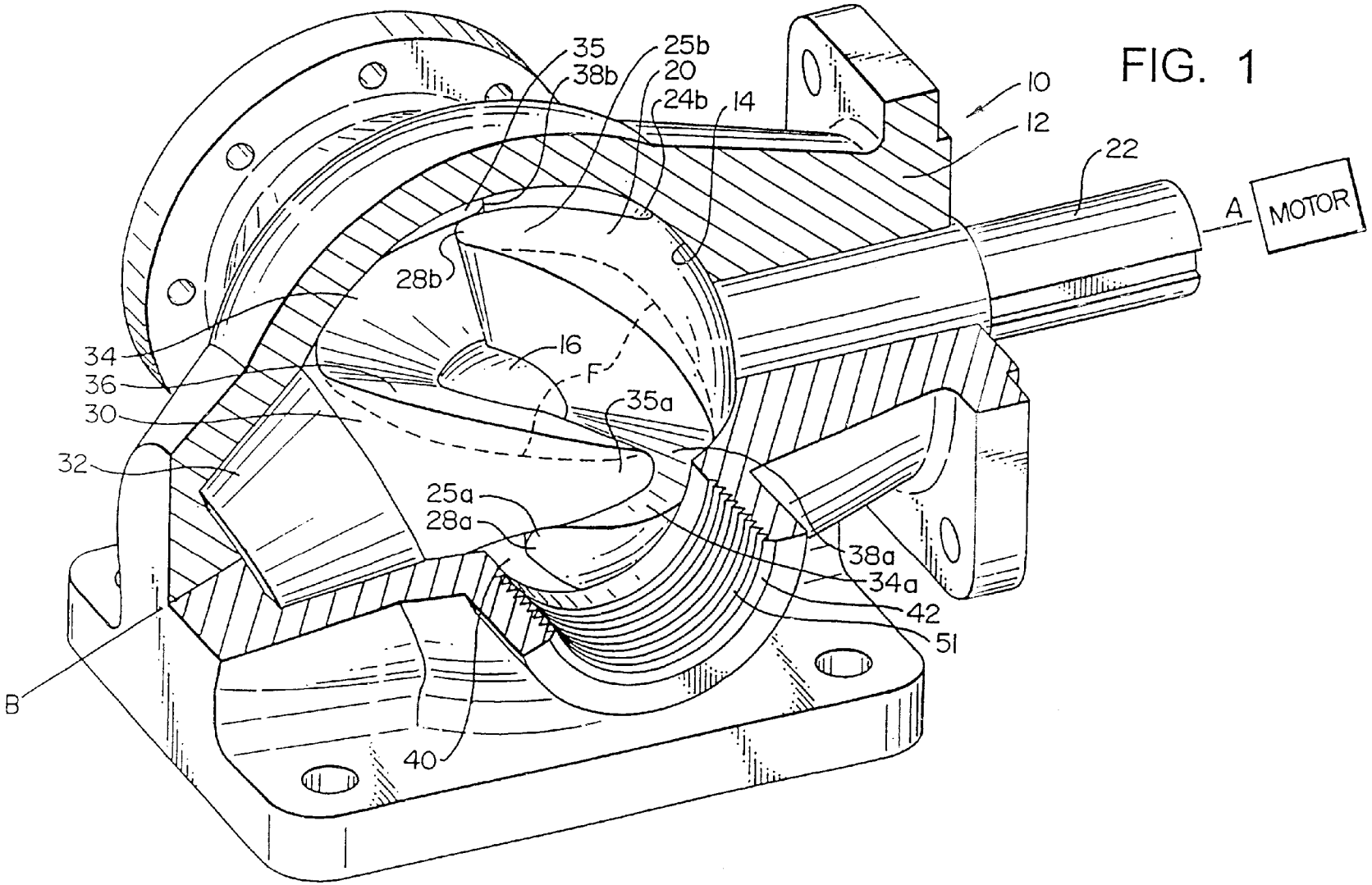
FIG. 1 is an isometric view of a master rotor and slave rotor housed within a ported housing according to one aspect of the invention.
Figure 1A:
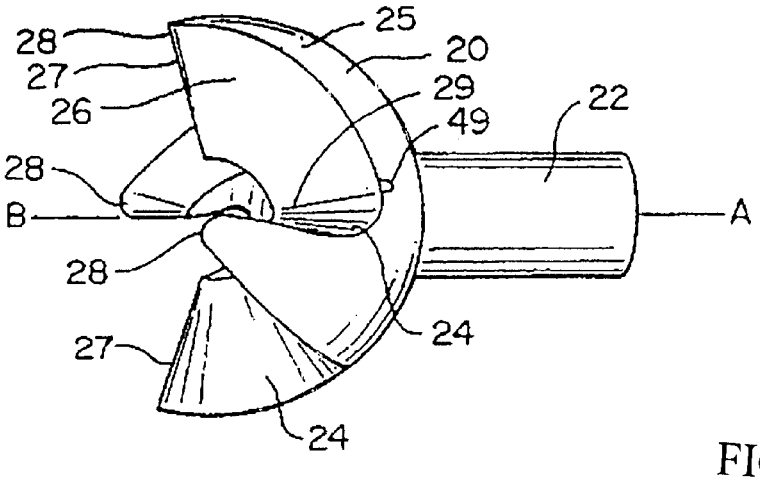
FIG. 1*a* is a top view of the master rotor of FIG. 6A showing the result of removing material from the master rotor between four vanes one face of each vane being formed as shown in the preceding Figure; FIGS.
Figure 1B:
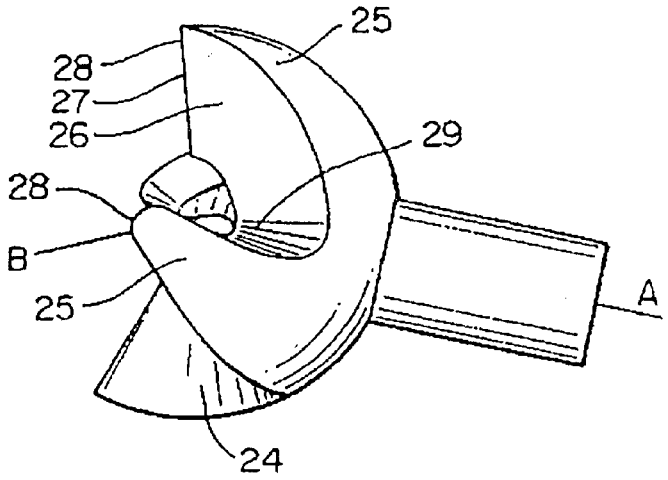
FIGS. 1*b* and 1*c* are a side view and isometric view respectively of the master rotor of FIG. 1A.
Figure 1C:
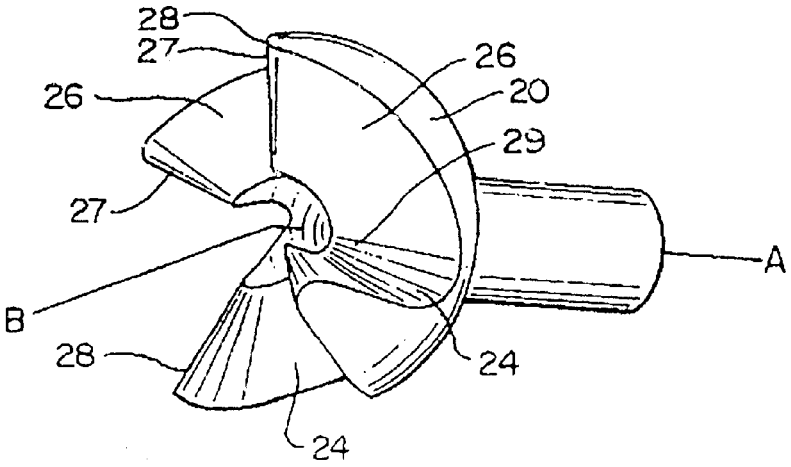

In FIG. 1 there is shown an engine 10 in accordance with one embodiment of the invention, formed by a housing 12 having an interior surface 14 defining at least a partially spherical cavity, with a central point at the center of bearing 16. A master rotor 20 is mounted for rotation on and within the housing 12 about a first axis A. The master rotor 20 includes a shaft 22 extending along the axis A and has contoured faces 24, 26 forming plural vanes 25 on the other side of the master rotor 20 from the shaft 22. A slave rotor 30 is mounted for rotation on and within the housing 12 about a second axis B. The slave rotor 30 includes a shaft 32 and has contoured faces 34, 36 forming a plurality of vanes 35*a* on the other side of the slave rotor 30 from the shaft 32. Each of the rotors 20, 30 defines at least part of a sphere, and share a common center coinciding with the center of the cavity. The vanes 25, 35 of the opposed faces of the rotors 20, 30 interlock with each other to define chambers. Axis A and axis B are non-collinear, being at an angle to each other, and intersect at the center of the cavity defined by the housing. The shaft 32 is journalled on an axle 33 (FIG. 9) in this example (configuration as a pump, turbine or hydraulic engine) since the slave rotor 30 need not be driven. The shaft 32 may also be cantilevered in the same manner as the shaft 22. The master rotor 20 and slave rotor 30 face each other within the housing in an axial direction, each being predominantly on one side of the common center of the rotors.

The portion of the interior surface 14 that is spherical is the portion in which both the vanes of the master rotor 20 and slave rotor 30 rotate. In an extreme position, where the vanes of one rotor extend into the shaft of the other rotor the vanes of both rotors extend into the shafts 22, 32. The shafts 22, 32 are not spherical, but rotationally symmetric. In addition, the master rotor 20 and slave rotor 30 should be generally spherical in the portions in which they overlap during operation. The remainder of the rotors 20, 30 and the interior surface 14 need only have rotational symmetry to the extent required to have the rotors 20, 30 rotate in the housing 12.

As will be seen, the contoured faces 24, 26, 34, 36 of the master rotor 20 and slave rotor 30 cooperate with each other and the interior surface 14 of the housing 12 to form chambers 40 (the space between the faces of the rotors) that change volume with rotation of the rotors 20, 30 about the axes A and B respectively. Ports 42 are provided in the housing 12 to allow fluid flow in and out of the chambers.

Each contoured face is formed from a contact face 24, 34 and a side face 26, 36 defining vanes (blades) 25, 35 between them. The contact faces 24, 34 form areas of contact between the two rotors 20, 30. Sealing of the chambers 40 is accomplished by close tolerance fit of the rotors 20, 30 against the housing 12 and bearing 16, as well as the relationship of the vanes 25, 35 with respective contact faces 24, 34. As is described in the above-referenced U.S. Pat. No. 5,755,196, the contours of the surfaces in a CvR™ engine of this type can be determined by defining the contact faces of the rotors by a locus which is formed as the rotors rotate about their respective axes by points on the other rotor, the points of each rotor that define the locus lying along an outer edge of a cone whose central axis is essentially a radius extending outward from the common centers of the rotors at an angle $\alpha/2$ from a normal to the axis of the other rotor. For purposes of the advantages of the present invention, however, the contours of the contact surfaces are preferably determined using the methods which are described below.

Side faces 26 connect inner ends 27 of one contact face 24 with the outer ends 29 of adjacent contact faces. The side faces 26, unlike the contact faces 24, have a somewhat arbitrary shape. Clearly, they should not stick out beyond the tips 28 of the vanes 25, else they will crash into the side faces 36 of the slave rotor 30. The shape of the side faces 26 can be adjusted for different volumetric ratio changes of the chamber 40 defined between the rotors 20, 30. The chambers 40 may compress to one seventh their maximum size (compression ratio 7:1) in a three vane case. For the embodiment shown by the dashed line in FIG. 1 the ratio will be less. For any single chamber, the point of maximum compression occurs when the vanes 25*a*, 35*a* are equidistant from the bottom of their rotation, that is from the line bisecting the acute angle between axes A and B. Enlargement of the chambers 40 may be accomplished by removing material from the side faces 26, 36 to render them concave. Dotted lines F in FIG. 1 show preferred cutting lines. The resulting chambers have considerable volume for the efficient pumping of fluid due to reduction in fluid velocity at the intake and exhaust chambers.

The master rotor 20 and slave rotor 30 could conceivably rotate cantilevered on their shafts 22, 32 respectively without additional bearings. However, contact problems and fluid loss at the center of the cavity poses considerable difficulties. It is preferred that a spherical bearing housing be formed by removal of a partial sphere of material from the center of each of the master rotor 20 and slave rotor; the spherical bearing housing houses bearing 16.

The laterally extending material of the rotors housing the bearing 16 is concave over greater than 180°, creating difficulties in construction. The bearing may be made integral with or otherwise fixed to either rotor, preferably the master rotor 20. For the other rotor, the bearing 16 can be loosely fitted in a less than 180° bearing housing, resulting in a greater leakage path, or the bearing may be press fitted into the housing, thermally contracted and inserted into the bearing housing, or slotted for insertion and rotated once inside the bearing housing to present a round bearing surface to the slave rotor.

As is shown in FIG. 1, the master rotor 20 is driven by a power source (not shown) through shaft 22. Vanes 25 of rotor 20 push on contact faces 34 of rotor 30 on the side shown on the other side (not shown) contact face 24 of rotor 20 push on vanes 35 of rotor 30.

Figure 2:
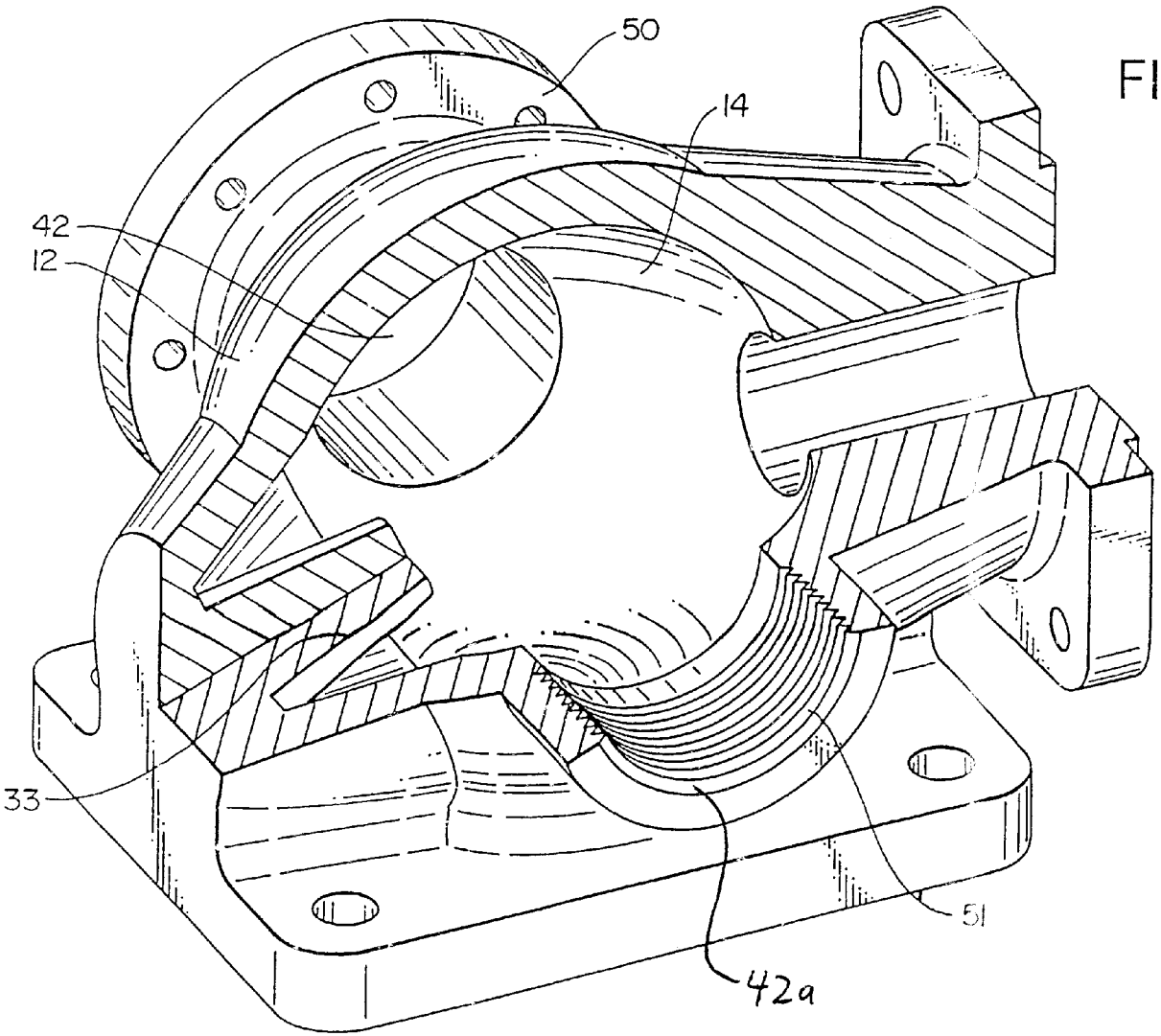
FIG. 2 is a schematic view showing the interior of the housing of FIG. 1.
Figure 3:
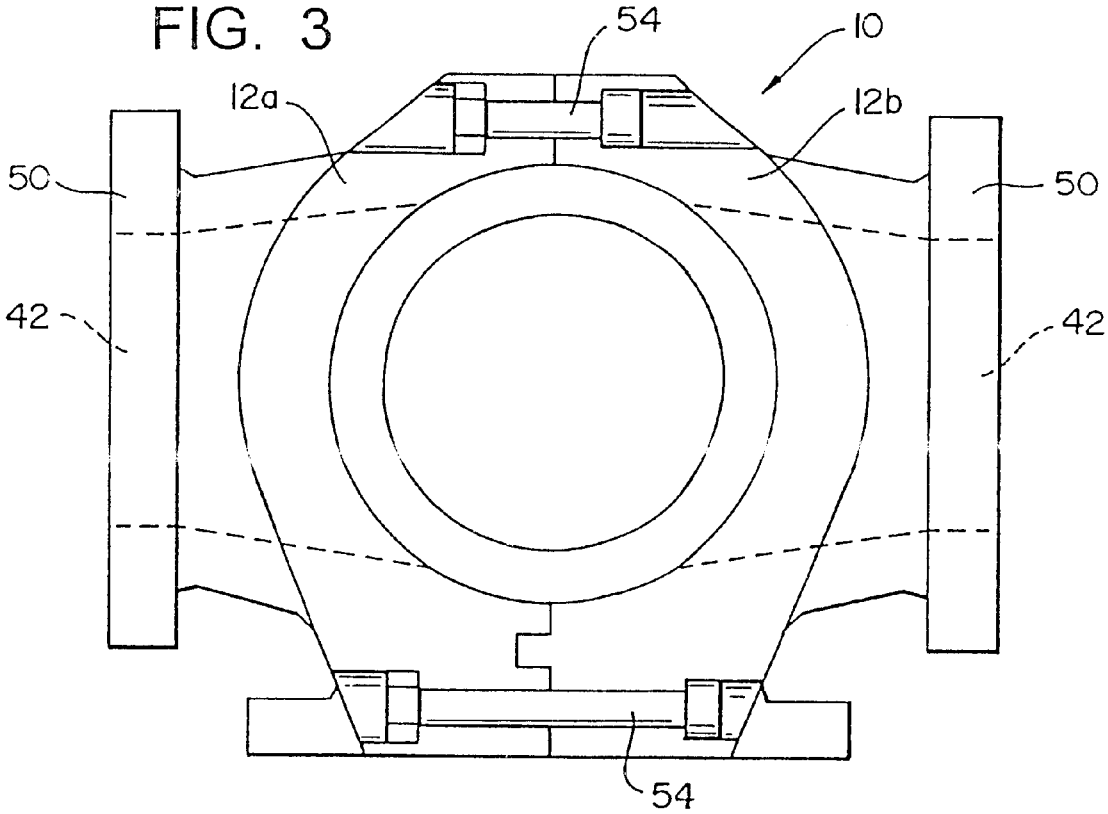
FIG. 3 is an end view, partially in section, of the housing of FIG. 1.
Figure 4:
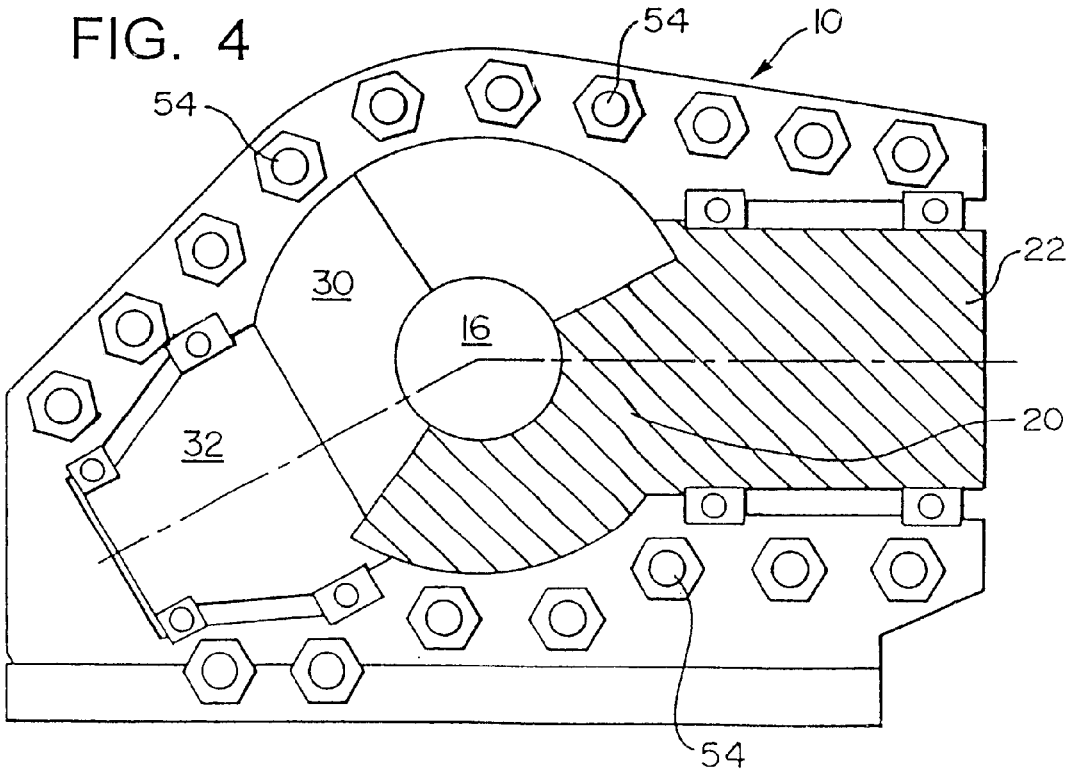
FIG. 4 is a schematic view partially in section, of the housing of FIG. 1 showing a cantilevered slave rotor shaft.
Figure 4A:
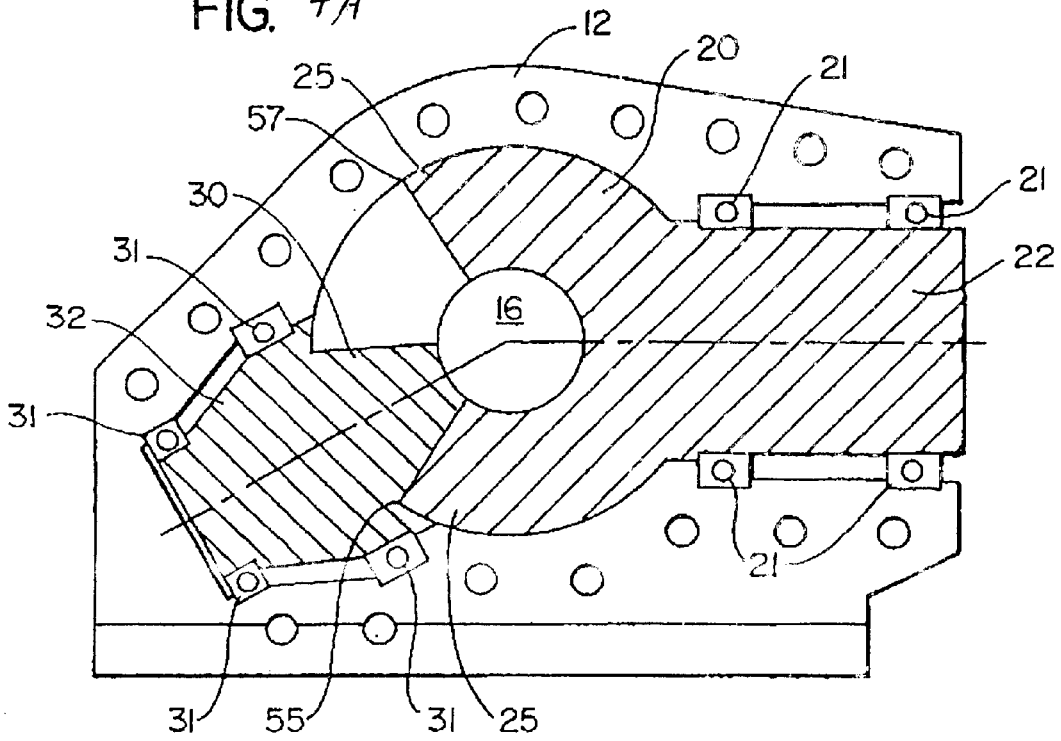
FIG. 4*a* shows a further embodiment of an engine according to the invention, in section, with vanes of each rotor extending into the shaft of the other rotor.
Figure 4B:
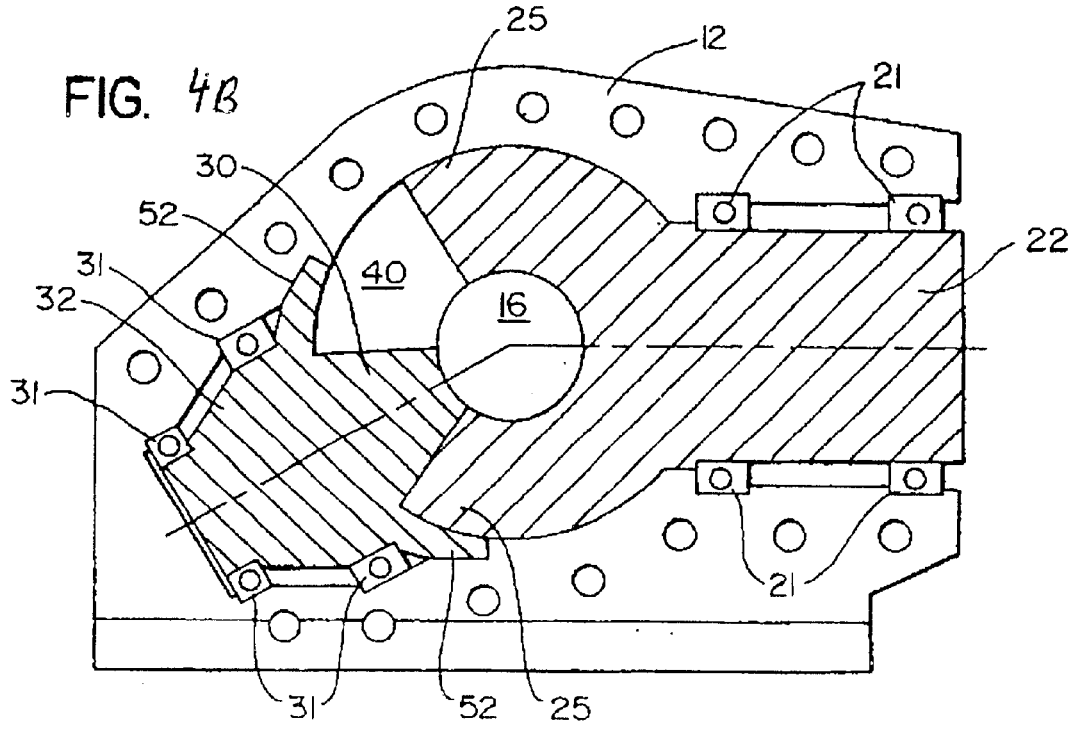
FIG. 4*b* is a section showing the embodiment of FIG. 4*a* with part of the shaft of the slave rotor extending around the master rotor.
Figure 4C:
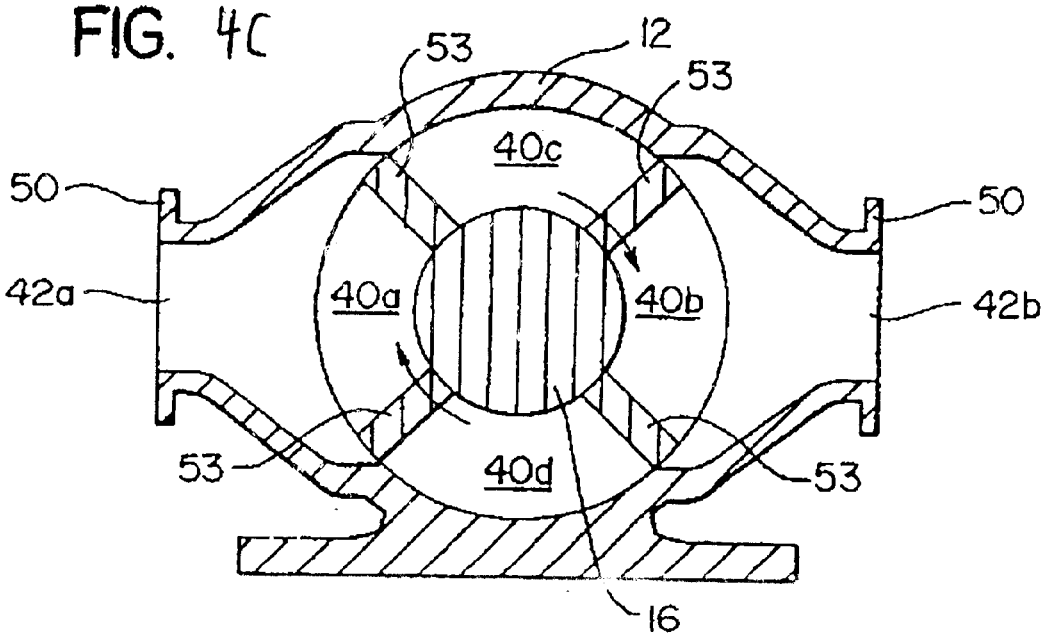
FIG. 4*c* is a schematic section through a stylized four vaned pump according to the invention, the section being taken along a plane bisecting the axes of the rotors, to illustrate port placement.
Figure 4D:
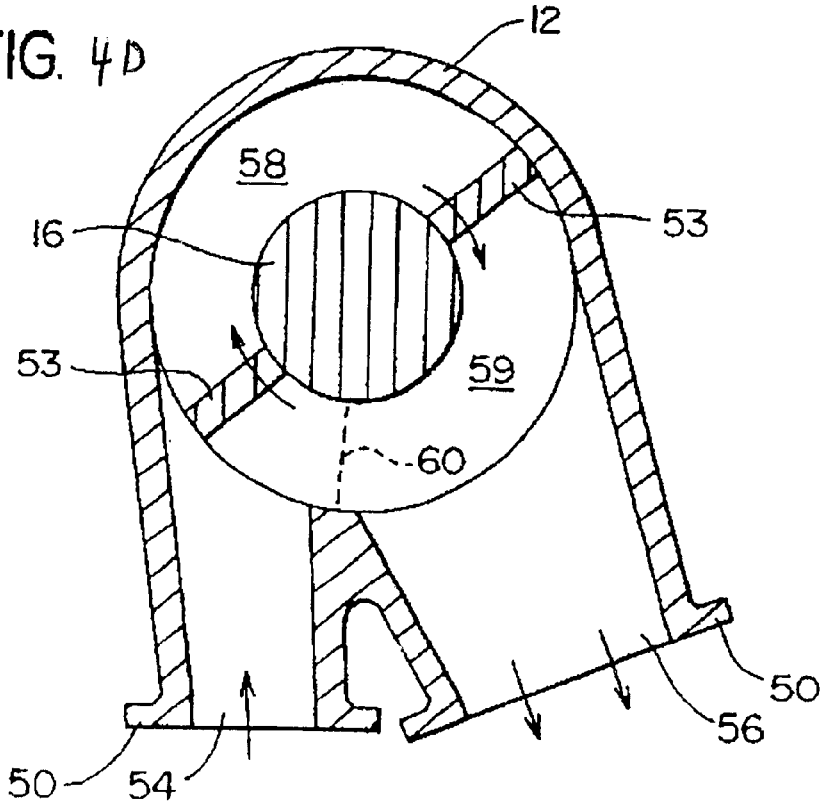
FIG. 4*d* is a schematic section through a stylized two vaned pump, the section being taken along a plane bisecting the axes of the rotors, also to illustrate port placement.

The internal and external configuration of the housing is shown in FIGS. 2, 3 and 4. In particular, the location of the ports 42 can be clearly seen, along with flanges 50 for connection of the housing 12 to input and output pipes (not shown). An alternative threaded coupling 51 is also shown in FIG. 1. The housing 12 is preferably formed of two halves 12*a* and 12*b* bolted together with bolts 54. The ports 42 are located at opposite sides of the housing, with an intake port 42*a* and outlet port 42*b*. As seen if FIG. 4*a*, areas 55 show contact areas of a vane on contact faces between the master and slave rotors 20, 30. Referring to FIG. 4*c*, fluid enters the intake port 42*a* in expanding chamber 40*a*. Chamber 40*c* is at maximum expansion in this rotational position. Chamber 40*b* is contracting and therefore forces fluid out of port 42*b*. Chamber 40*d* is at maximum compression in this rotational position. Preferably, the ports 42 have peripheries that match the chamber configurations at the point the chambers cross the boundaries of the ports so that as many points as possible of the chamber edge, defined by a pair of vanes 24, 34, cross the port edges at the same time. The trailing edge of the set of vanes beginning to cross the exhaust port or intake port defines the preferred shape of the port at that position. The leading edge of the vanes exiting the intake port or exhaust port defines the preferred shape of the port at that position.

For operation as a pump, the master rotor is driven by a power source. Rotation of the master and slave rotors with each other causes the chambers 40 to contract while moving from the point of maximum separation of the rotors at the top to the point of minimum separation of the rotors at the bottom. On the other side, the chambers expand. While expanding, the chambers intake fluid, and while contracting the chambers expel fluid, increasing the velocity and/or pressure of the fluid, and energy of the fluid. Thus, energy of the motor driving the pump is converted to energy imparted to the fluid.

The parts described here may be made of any suitable materials including plastics and metal, depending on the intended use. Steel may be used for the master rotor 20, while brass may be used for the slave rotor 30. At 10,000 rpm., a steel and bronze pump is believed to be able to produce 10 hp per lb. weight of pump, and 20 hp per lb. weight of pump for titanium rotors. As will be described below, care must be taken to provide close tolerance fits of the vanes so that little fluid can escape past the vane contacts and between the rotor and the casing. Material may also be added to the vanes to allow wear.

This invention provides a positive displacement rotary pump with high efficiency, believed to be over 90% overall efficiency, and for a pump with eight inches outside diameter, with seven inch diameter rotors, is believed to be able to pump one liter per revolution. 100% rotary motion provides low stress on parts and low vibration. Applications include irrigation, fire fighting, down-hole water and oil pumping, hydraulics, product transfer pumps and high rise building water pumps.

b. Mirror Image Contact Surfaces

A preferred embodiment of the invention is shown in FIGS. 5–7C, the engine in this exemplary embodiment being configured for use as a pump, although again it will be understood that the engine can be configured as an external combustion engine or other power source. As will be described in greater detail below, a particular enhancement featured in the embodiment which is shown in FIGS. 5–7*c* lies in the mirror image contact surfaces which are provided on the leading and trailing sides of the "lobes".

Figure 5:
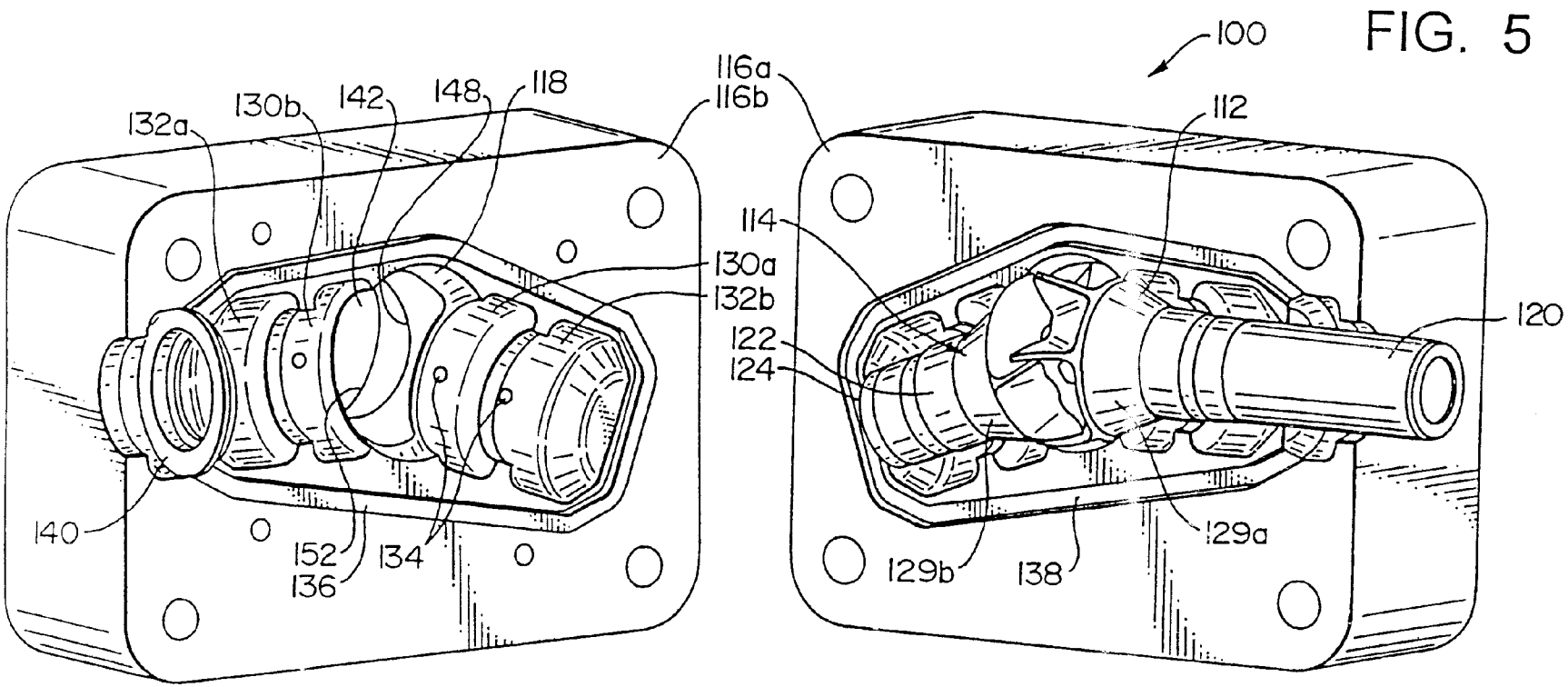
FIG. 5 is a perspective view of an engine in accordance with a further embodiment of the invention, with the casing and the pump being shown separated to expose the internal components thereof, this embodiment of the invention having vanes with mirror image contact surfaces which maintain closer operating tolerances between the vanes and also permit the engine to operate in a reverse direction.
Figure 6:
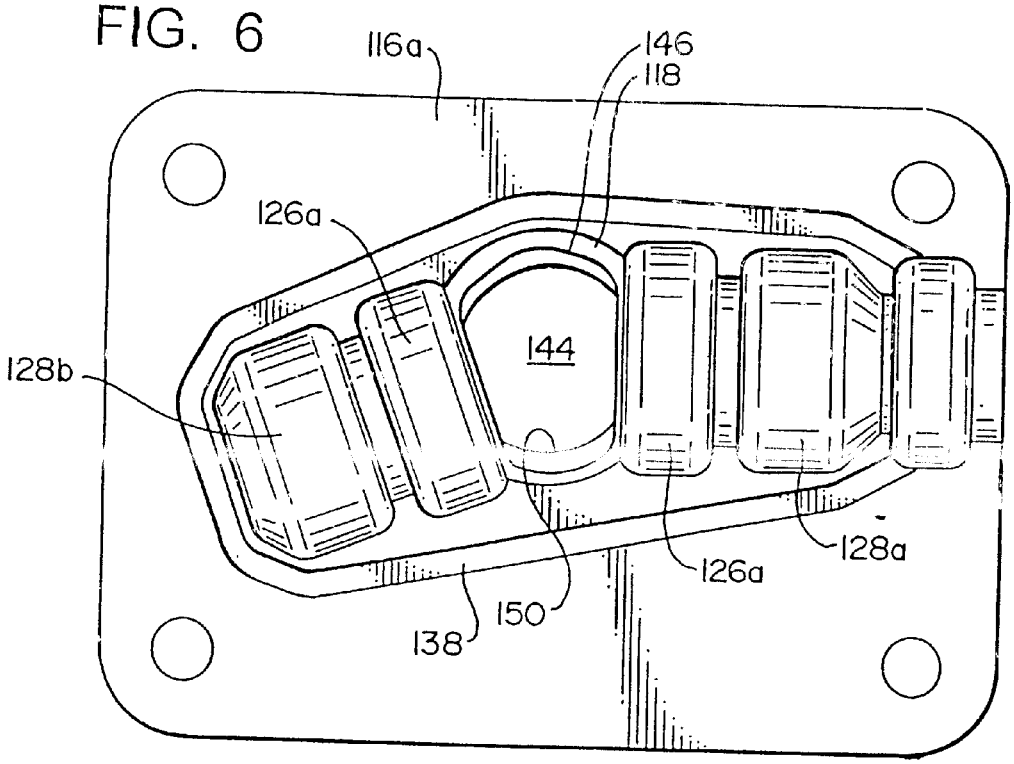
FIG. 6 is an elevational view of a first half of the engine casing of FIG. 5, showing the port, seal and bushing structure thereof in greater detail.
Figure 7A:
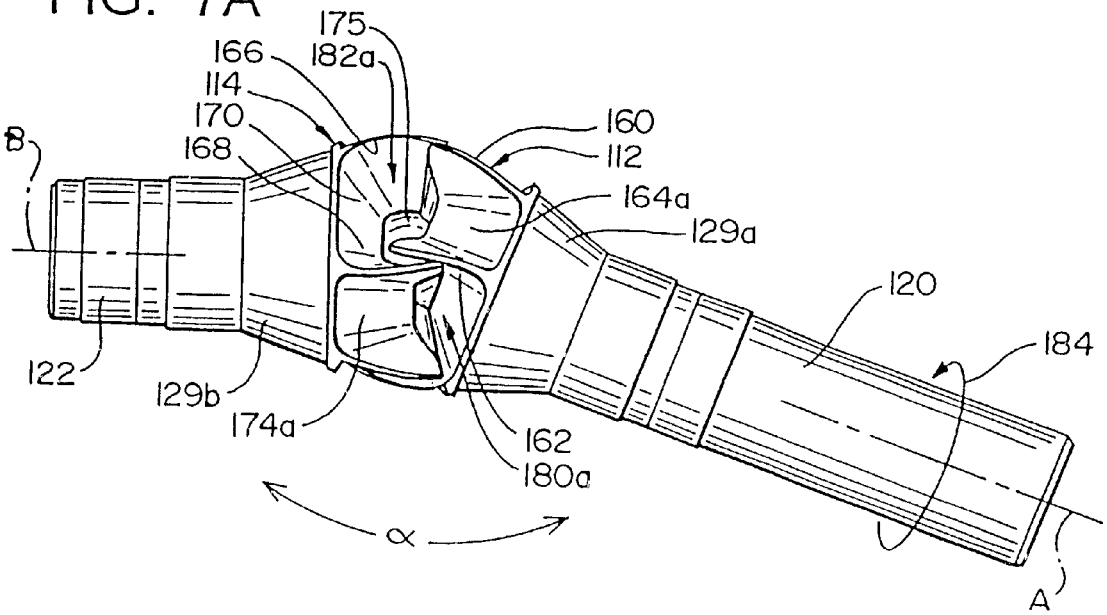
FIG. 7A is a side elevational view of the slave and master rotor of the engine of FIG. 5, showing the engagement of the contact surfaces and the incidence angle between the two rotors.

As with the embodiment of FIG. 1, the engine 100 as shown in FIG. 5 includes a master or power rotor 112 which rotates about a first axis A and slave or passive rotor 114 which rotates about a second axis B which is offset from the first axis A by an angle θ (see FIG. 7A). The rotors are housed between the two halves 116*a*, 116*b* of an external casing which seals and supports the assembly and also has inlet and outlet ports for the flow of fluid through the engine.

Each rotor 112, 114 is partially spherical with a common center, and the casing includes a corresponding spherical cavity 118 which receives and holds the rotors in engagement. The end shafts 120, 122 of the master and slave rotors are supported by the casing. The terminal end 124 of the slave rotor 114 terminates and is fully enclosed within the casing 116, which provides the advantages of simplified sealing and reduced cost of manufacture, although it will be understood that in some embodiments the slave rotor shaft may extend through the exterior of the casing. The master rotor end shaft 120, in turn, extends outwardly from the casing and is connected to a suitable external power source (not shown), such as an electric, hydraulic or other motor.

Each end shaft is supported in a pair of bearings 126 and 128 to maintain shaft stability and eliminate end play. The inner bearings 126 include conical bearing faces (not shown) which engage corresponding conical tapers 129*a*, 129*b* on the backs of the rotors, so as to react against thrust loads and maintain the rotors in proper engagement. The bearings are received in corresponding cavities 130, 132, with lubricant being supplied to the cavities through a series of ports 134. The bearings are preferably high speed fluid film bushings, i.e., bushings which run on a thin film of air, oil, water, etc., although it will be understood that other forms of high speed bearings may be employed in some embodiments. A continuous elastomeric seal 136 is retained in a channel 138 which extends completely around the rotor chamber and shafts, and includes a ring seal 140 which surrounds the master rotor and shaft where this exits the housing; the seal 136 may suitably be formed of a moldable polyurethane material. The clamping force of the two casing halves against the elastomeric member provides the low pressure seal for the assembly, while the fluid pressure acting outwardly against the elastomeric material creates the high pressure seal.

As was noted above, the casing also includes an inlet port 142 and an outlet port 144, which communicate with the rotor chamber 118 and via which the fluid enters and leaves the engine; the inner edges 146, 148 of the ports, where these meet the spherical rotor chamber, have a shape which matches the corresponding edges of the contact surfaces which define the sealed chamber between the rotors (which shape will be described in greater detail below), while the outer edges 150, 152 of the ports are round for connection to conventional circular cross-section tubing or other conduits.

FIG. 7A shows the engagement of the first and second mirror image contact surfaces 160, 162 on each vane 164, and the contact surfaces 166, 168 on the corresponding cavity 170. This engagement forms a substantially sealed chamber which changes in volume with rotation of the rotors. In contrast to the embodiment described above with reference to FIGS. 1–4, however, each vane or lobe is provided with two mirror image contact surfaces, i.e., a leading contact surface and a mirror image trailing contact surface.

Figure 7B:
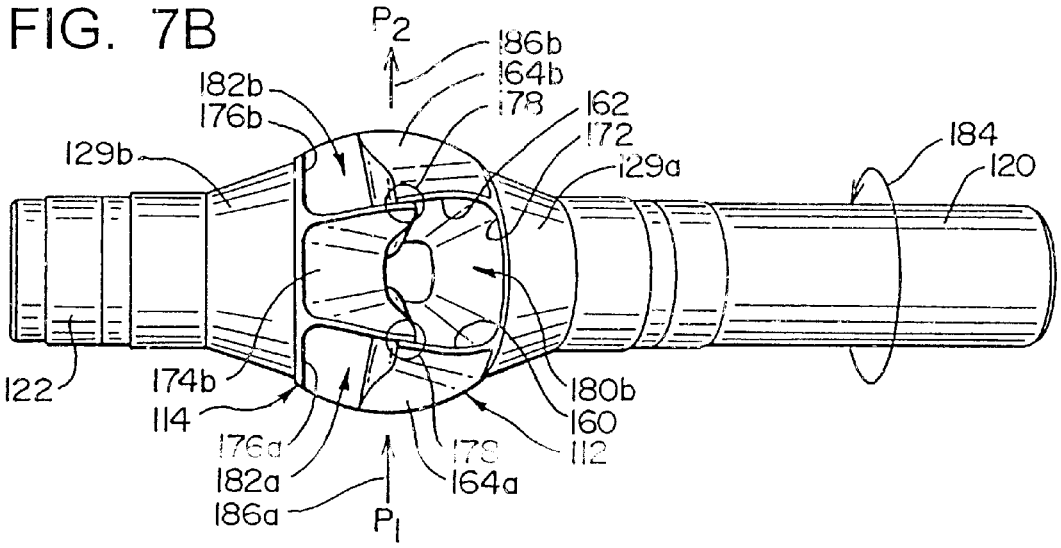
FIG. 7B is a top plan view of the master and slave rotors of FIG. 7A, showing one of the chambers at its point of maximum volume.
Figure 7C:
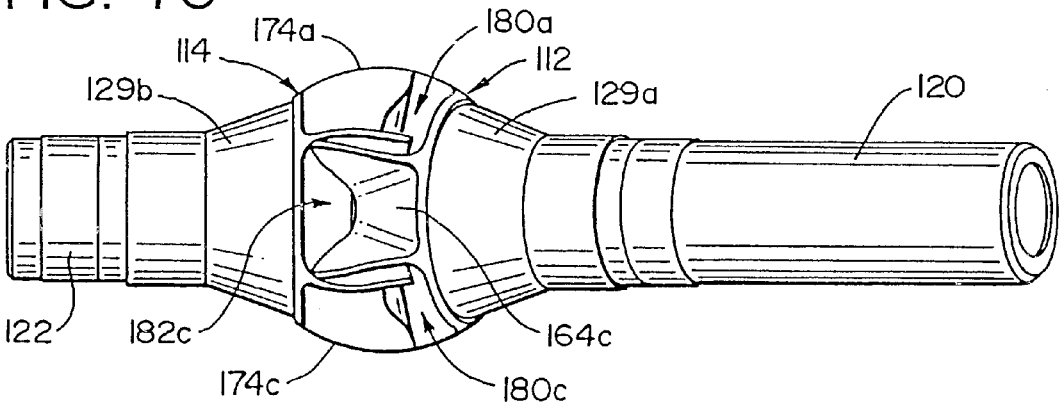
FIG. 7C is a bottom plan view of the master and slave rotors of FIG. 7A, showing the chamber at its point of minimum volume.

The relationship between the leading and trailing contact surfaces is perhaps best seen in FIG. 7B, which is the top or "overhead" view of the master and slave rotors 112, 114. As can be seen, the lobes 164*a*, 164*b*, etc. of the master rotor 112 are angularly spaced so as to define a plurality of angularly spaced cavities 172, and the lobes 174 on the slave rotor define corresponding cavities 176. As can also be seen, each lobe is received in the corresponding cavity in the opposite rotor i.e., the master rotor lobes 164 are received in the cavities 176 in the slave rotor, and the slave rotor lobes 174 are received in the cavities 172 in the master rotor. The area in the center of the rotors, between the lobes on either side, is sealed by a ball 175 or other generally spherical body.

As can also be seen in FIG. 7B, the leading and trailing contact surfaces on each lobe engage the corresponding contact surfaces on each socket (these being the contact surfaces of the lobes on either side of the socket), as indicated at the areas 178. Consequently, a series of sealed chambers 180*a*, 180*b*, 180*c* are formed about the end of the master rotor, between the ends or "heads" of the lobes in the bottom of the cavities, and a corresponding series of sealed chambers 182*a*, 182*b*, 182*c* are formed around the end of the slave rotor.

The chambers change in volume with rotation of the rotor assembly, in the direction indicated by arrow 184. As can be seen by comparison of chambers 180*a* and 182*a* in FIG. 7A, the volume of the chamber increases as these rotate past the inlet port 142 (see FIG. 5), thus drawing fluid into the pump. The ports are shaped so that each chamber moves out of register with the inlet port just as the chamber reaches its maximum volume (see chamber 180*b* in FIB. 7B), and just before the chamber begins to rotate into register with the outlet port 144. The chambers then decrease in volume as they rotate past the outlet port, forcing the fluid outwardly, and reach a minimum volume at the bottom of the cycle (see chamber 182*c* in FIG. 7C) just after rotating out of register with the outlet and prior to opening into the inlet port. As a result, the fluid enters the pump through the inlet port at a first pressure indicated at P1 and is discharged through the outlet port at a second, higher pressure indicated at P2, as shown generally by arrows 186*a*, 186*b* in FIG. 7B.

The embodiment having the lobed vane structure with mirror image leading and mirror image contact surfaces has several advantages over the device which is shown in FIGS. 1–4. Firstly, the use of mirror image contact surfaces enables the engine to run and develop pressure in either direction of rotation. This is because the mirror image contact surface lobes do not require the force of the faster (power) rotor vanes pushing against the slave rotor vanes in order to maintain a contact seal.

Moreover, the mirror image contact surfaces on the lobes enable an acceptable fluid film between the surfaces at a wide range of operating speeds and fluid viscosities. Maintaining a thin fluid film between the contact surfaces is advantageous for reducing wear and friction. However, when operating at high speeds and low back pressures the fluid tends to force the contact surfaces apart, creating an excessively thick fluid film. This results in a large amount of leakage, or back flow and reduced operating efficiency. The mirror image contact surfaces control the amount of "backlash" between the slave and power rotors, so that only the predetermined amount of rotation is allowed between the two, which in turn defines the maximum clearance/fluid thickness there can be between the leading and trailing contact surfaces of the lobes. Due to the force of the power rotor, the fluid film at the leading contact surface of each lobe will tend to be slightly less than that of the trailing contact surface; however, depending on operating speed, back pressure, fluid viscosity and other factors, an equilibrium level is achieved in which a fluid film exists between both leading and trailing surfaces.

Additional advantages include increased strength of the rotor lobes, since the area between the mirror image contact surface (i.e., the backs of the contact surfaces) can be filled in, so that the back side of each of the faces is reinforcing the other, giving the lobes strength comparable to that of a gear tooth. Also, because of the higher strength, it is possible to operate the pump at higher pressures, which is advantageous in increasing the power ratio, or power density, of the pump.

c. Mathematical Calculation of Contact Surface Contours

The manner in which the contours of the contact surfaces are determined mathematically will now be described with reference to FIGS. 8A–10D.

Figure 8A:
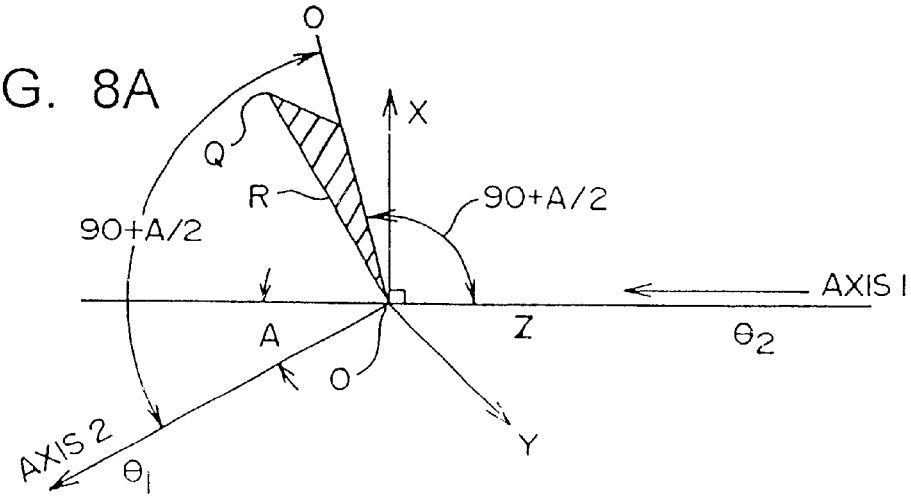
FIGS. 8A–8E are a series of geometric figures showing axes, distances, angles, vectors, and other values associated with the mathematical determination of the contact surface contours in accordance with the present invention.

FIGS. 8A–8D provide a series of graphical representations of axes, vectors, angles, and other values associated with the mathematical computation of the contact surfaces of the vanes/lobes, as follows:

FIG. 8A shows the orientation of the two rotor axes, Axis 1 and Axis 2, intersecting at O and placed at an angle A° apart. The line O—O is initially in the plane of the two axes and bisects the direction of each, so that it makes an angle of (90+A/2)° with each axis direction. Point Q is a radial line on the surface of a sphere of radius R, which is a point locating the working surface of the rotor attached to the shaft having Axis 2. The plane P formed by the line O—O and OQ will be a plane that changes orientation in space.

Figure 8B:
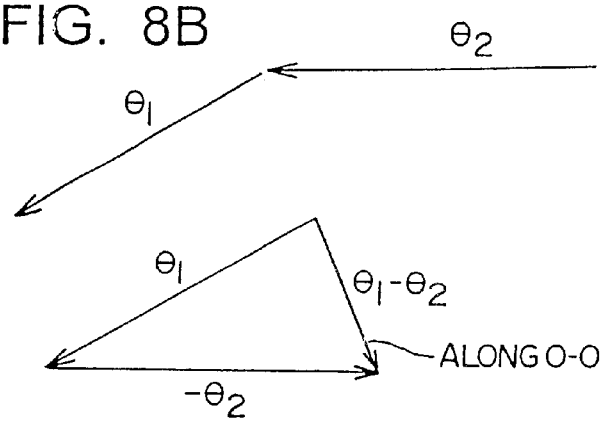

When the pump turns about each axis by the same angle, $\theta=\theta1=\theta2$ as shown. To construct the rotor surface on Axis 2, we need to consider the relative motion of Axis 1 with respect to Axis 2. Taking a vector difference of rotations as shown in FIG. 8B, makes the axis of rotation lie along the direction of vector θ1–θ2, which is the direction of the line O—O in the starting position shown when θ=0. A superposition of two rotations can be used to get the new direction of O—O for other angles. First, the line O—O is rotated about Axis 1 an angle of θ. Thus, with Axis 1 fixed, O—O is rotated θ in the opposite direction, or the −θ2 direction. By analyzing the displacement components involved in this operation, the xyz coordinates of the point Q' can be determined as $$\frac{x}{R_0} = -\sin^2\frac{A}{2}\cos\frac{A}{2}\cos(2\cos\theta - \cos 2\theta) - \cos^3\frac{A}{2}$$

$$\frac{y}{R_0} = -\sin^2\frac{A}{2}\cos\frac{A}{2}(2\sin\theta - \sin 2\theta)$$

$$\frac{z}{R_0} = -2\sin\frac{A}{2}\cos^2\frac{A}{2}(2\cos\theta - \cos 2\theta) - \cos^3\frac{A}{2}$$

where $R_0 = R\cos\sigma$

As θ increases, point Q describes a curved path in space and plane P must remain perpendicular to the tangent to that curve. This can be insured by making the plane be perpendicular to a tangent vector, which can be found from the direction of the velocity of either point Q or point Q', which remain a fixed distance apart, OO'=Rsino.

Figure 8C:
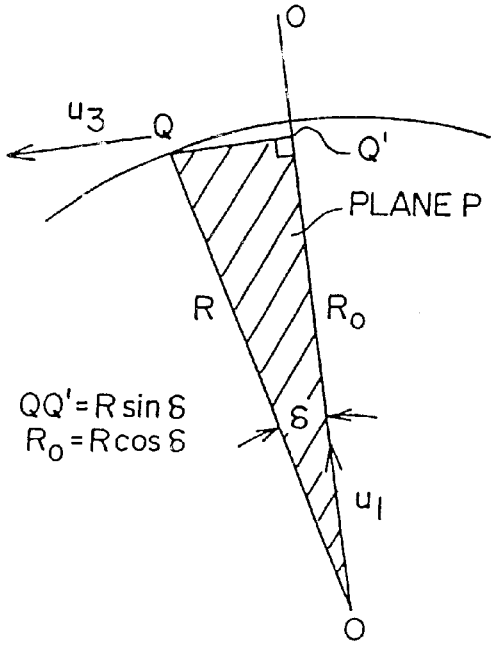

A set of unit vectors can be used to describe the orientation of plane P in space. As shown in FIG. 8C, let u1 be the first vector, directed along O—O, and is defined in terms of the vector $R_O$:

Since $R_0=R_0=u1$ $$u1 = \frac{R_0}{|R_0|} = \frac{1}{R_0}[x, y, z]$$

where $R_0=(x^2+y^2+z^2)^{0.5}$

Vector u2 is tangent to the path of Q' and is obtained from the vector cross product to get the velocity of Q.

$$V_Q=u0\times R_0 u1$$

$$V_Q=[\cos\triangleq\cos\theta, \cos\triangleq\sin\theta, -\sin\triangleq]\times[x,y,z]$$

where the component of the two vectors are given. The vector uO is a unit vector with direction along O—O, which changes with rotation, as does u1.

The unit vector along the tangent of the path of Q' or Q will be $$u2 = \frac{V_Q}{|V_Q|}$$

and will be a function of both the shaft angle A and the rotation θ.

A third unit vector, perpendicular to both u1 and u2 will be $$u3=u1\times u2$$

and will be in a transverse direction, along QQ'.

The coordinates of the point Q can now be determined from the vector equation, $$OQ=R=R\cos\delta u1+R\sin\delta u3$$

in which $$OQ'=R_O-R\cos\delta u1$$

Figure 8D:
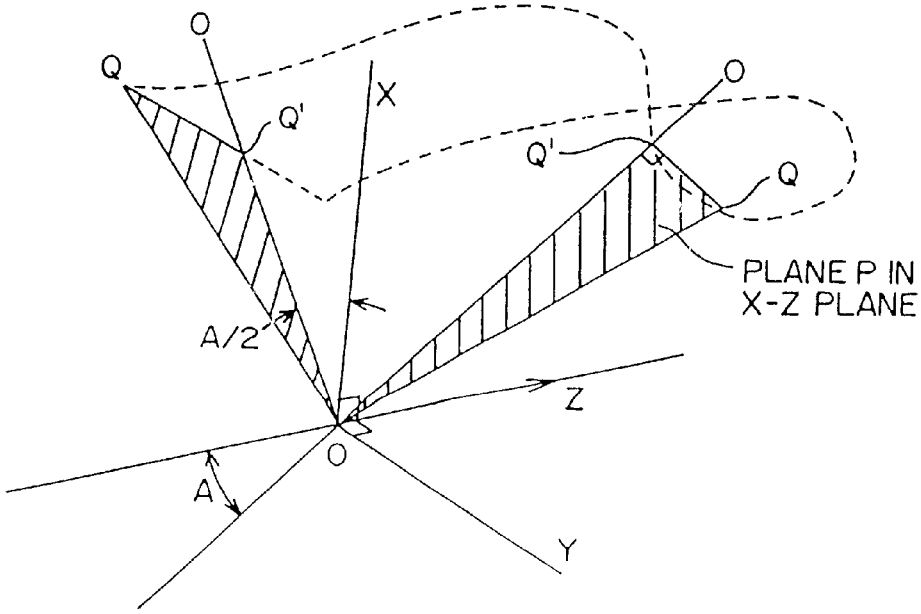

The outer edge of the surface determined by Q is shown in FIG. 8D. Also shown is the rotation of plane P for different rotations of the shafts.

The total angular twist S, along the axis O—O in any general position can be most easily obtained by determining the angular change in the normal to the plane P, which is the unit vector u2.This vector is always directed along the tangent to the path of Q or Q', and has already been defined.

Figure 8E:
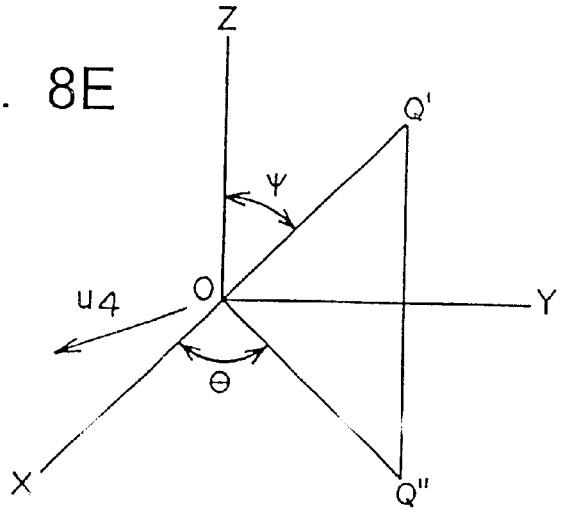

As is shown in FIG. 8E, the untwisted position of the plane P can be obtained by rotating the plane and its initial normal direction vector u2 about the z axis in the xy plane through the angle θ, to a new position u2'$_O$ and again about the plane OQ'Q" through the angle □ with the Z axis in the x-y plane through the angle θ, to a new position u2'$_O$ and in the plane OQ'Q" until it makes an angle □ with the Z axis to a final position u2"$_O$. These angles are related to the xyz coordinates by $$\tan\theta = \frac{y}{x} = \frac{2\sin\theta - \sin 2\theta}{\cot^2\frac{A}{2} + 2\cos\theta - \cos 2\theta}$$

$$\cos\psi = -\frac{Z}{R_0} = \sin\frac{A}{2}\left(2\cos^2\frac{A}{2}(1-\cos\theta) - 1\right)$$

This rotation of u2$_O$ to u2$_O$" is done best by defining another unit vector perpendicular to the plane OQ'Q", which is:

$$u4=[\sin\theta, -\cos\theta, 0]$$

and then generating yet another unit vector from $$u5=u4\times u1$$

This vector u5□u2$_O$" represents the untwisted position of plane P, and u2 represents the twisted position. The angle between them in space will be the total rotation about the axis O—O. This is found from the dot or cross product of the two vectors. Using the dot product, $$\cos S=u2.u5$$

$$\cos S=u2x\ u5x+u2y\ u5y+u2z\ u5z$$

from which the angle S is determined from the xyz components of the two vectors.

FIGS. 9A–9D are a series of views of a model which provides a visual representation of the relationships between axes and points in the system described by the mathematical process above.

Figure 9A:
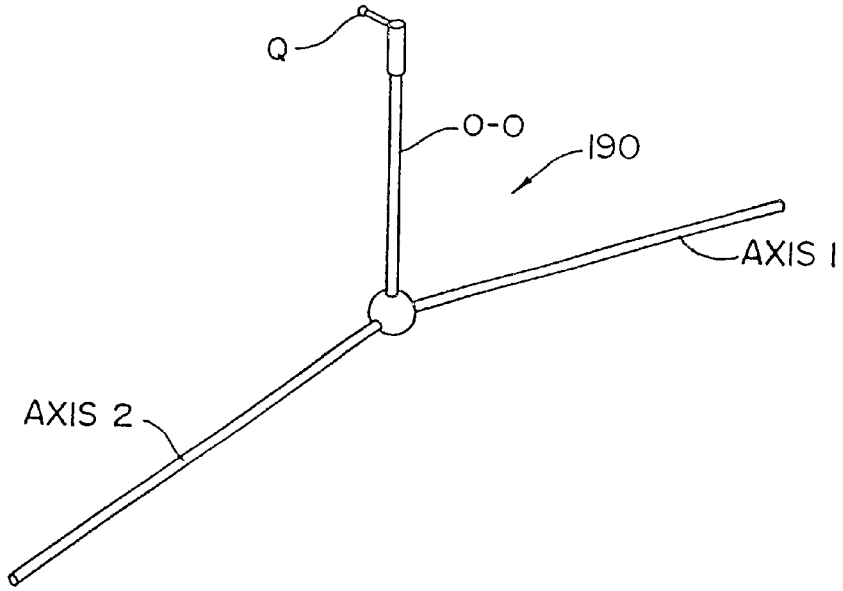
FIGS. 9A–9D are a series of views of a visual model illustrating the method by which the contours of the contact surfaces are determined in the present invention, by conceptual rotation of predetermined system axes based on a predetermined mathematical relationship.

FIG. 9A shows the "start" position, in which the axes 1 and 2 correspond in angular relationship to the axes of the master and slave rotors, the length O–Q represents the radius of the rotor, and the point Q, on a line normal to axis R, represents one point along the contact surface of the lobe. The offset between O—O and Q, in turn, represents the surface depth of the lobe. By conceptually rotating the Axis 1 through about 90–180° and following the mathematical process set forth above, the point Q sequentially plots out a line having a contour of a line on the contact surface of the lobe.

For purposes of illustration, FIGS. 9A–9D show rotation of Axis 1 90° from the start position to the final position; it will be understood, however, that determination of the line is ordinarily carried out in small degree increments, so as to define a smooth, continuous contour.

Figure 9B:
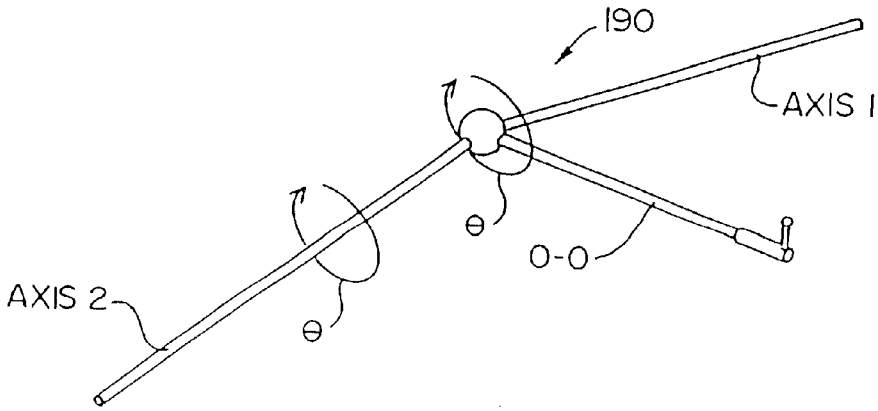
Figure 9C:
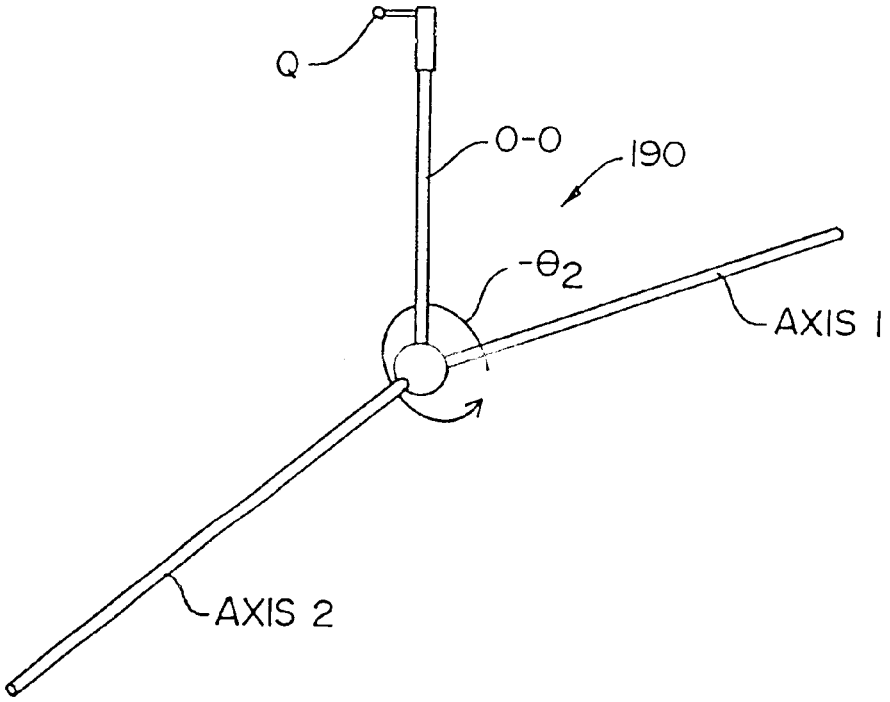
Figure 9D:
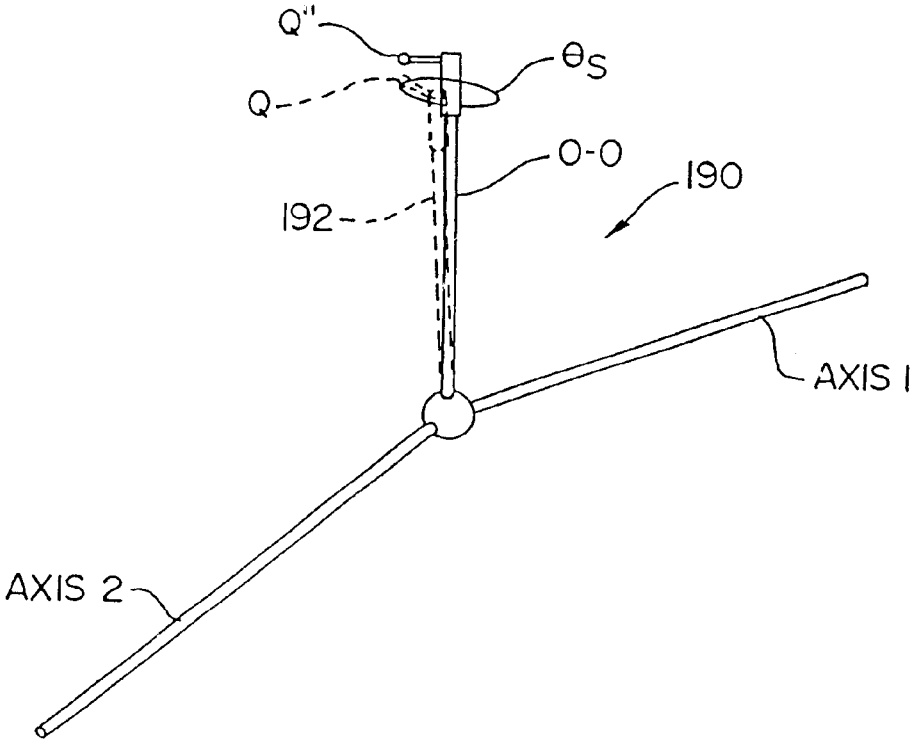

Accordingly, FIG. 9B shows the model 190 with the Axes 1 and 2 having been rotated together by an angle θ of 90°, so that axis R swings from the vertical alignment (for purposes of illustration) is shown in FIG. 9A to the horizontal alignment in FIG. 9B. Then, with Axis 1 held stationary, Axis 2 is rotated back by an angle −θ, which is equal to θ but in the reverse direction, rotating axis R to the position is which is shown in FIG. 9C. Finally, the axis R is rotated by the amount $\theta_S$ which is calculated in accordance with the mathematical system described above, bringing point Q to its final position Q", as shown in FIG. 9D. For purposes of illustration, FIG. 9D also includes a broken-line image 192 which shows the original position of point Q at the start point shown in FIG. 9A.

FIGS. 10A–10D are a series of views similar conceptually to FIGS. 9A–9D, but showing the manner in which the above process is used to generate or determine a contoured line 194 in a computer plotting program. As can be seen, by following the process described above, the point Q is moved sequentially from position to position line 194, with each rotation of the Axes 1 and 2. By in essence "connecting the dots", i.e., the position of point Q at each position of Axis 1, a continuous contour line is created which corresponds to the contour line along one of the contact surfaces, such as the contact surface 160 on lobe 164, as shown in FIG. 10E.

The offset establishes sufficient clearance between the contact surfaces to establish the fluid film and avoid the parts rubbing directly on one another. The amount of the offset is determined on a basis of fluid type and viscoscity, operating speeds and pressures, and materials characteristics, along with other factors. Also, in some embodiments where the rotors are formed of resilient material such as urethane, a "negative" offset may be used, so as to cause some interference between the contact surfaces which forms an enhanced seal; this may be particularly desirable for high-pressure, low-speed applications.

Having established the contour line at the outer edge of the lobe (i.e., at the full radius of the rotor), the three-dimensional surface is generated by one of two methods. Firstly, the contour line can simply be scaled down towards the center of the rotor, in which case the clearances and thickness of the fluid film will also decrease towards the center accordingly. In other embodiments, the contour line can be recalculated at the smallest radius at the lobes/vanes, with the intermediate contour lines defined accordingly, so as to give a constant gap/fluid film thickness across the entire contact surface; this approach may be particularly advantageous where the fluid contains particulates of a known size, and it is therefore important to maintain a fluid film which is thick enough to hold the particulates without these being forced into the contact surfaces. Whichever approach is used, one contour can be calculated for the leaving contact surface of the lobe and then reversed for the mirror image trailing contact surface, or vice versa.

Figure 10A:
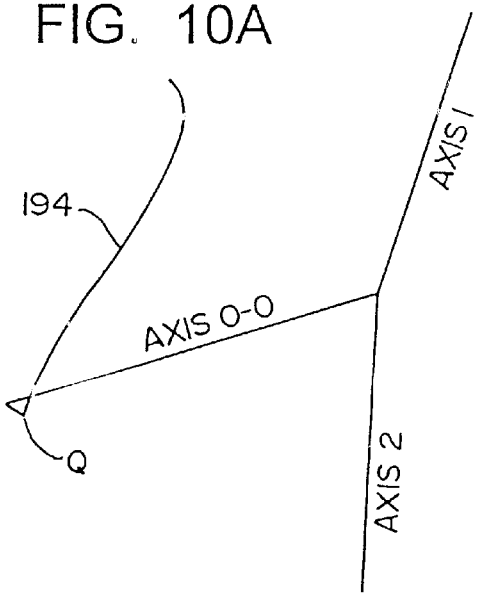
FIGS. 10A–10D are a series of computer-generated graphical images, illustrating the manner in which the contours of the contact surfaces are determined using the mathematical relationship in accordance with the present invention.
Figure 10B:
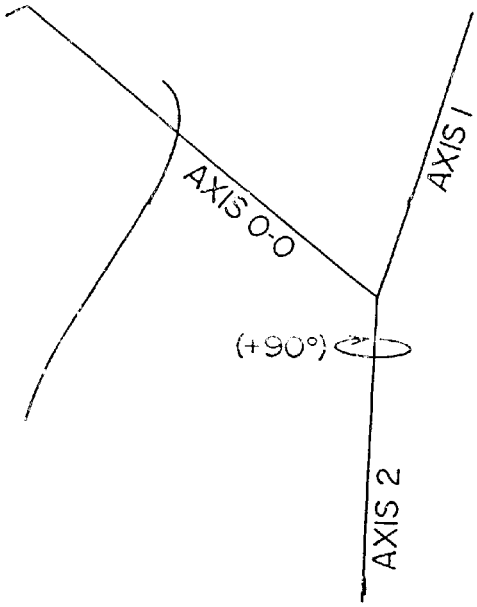
Figure 10C:
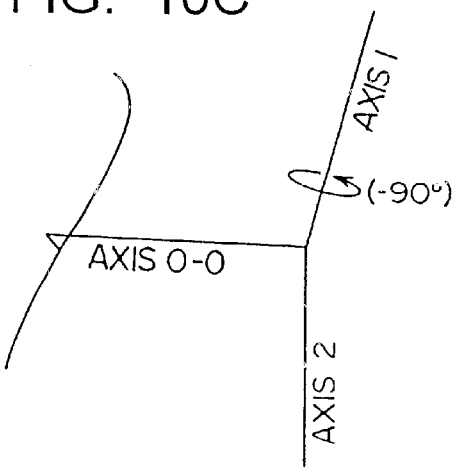
Figure 10D:
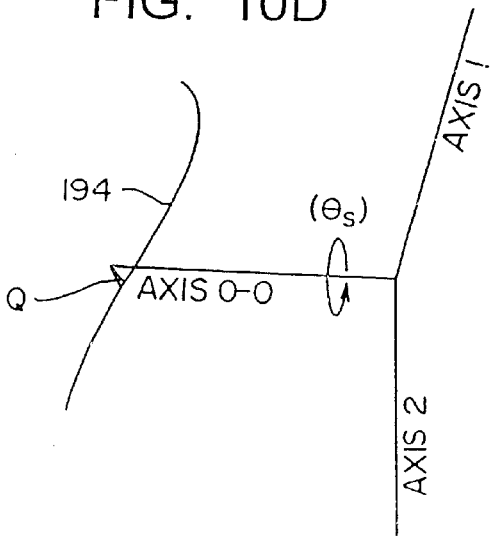
Figure 10E:
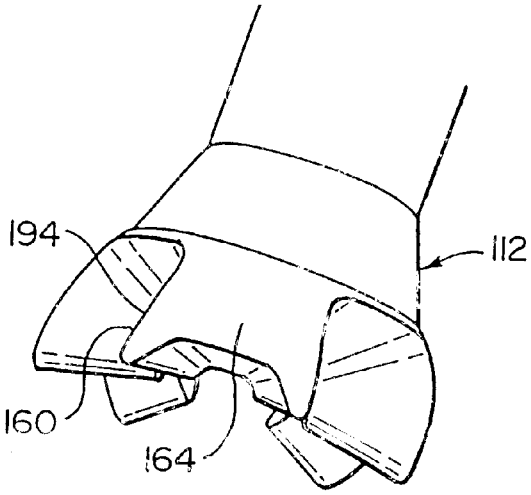
FIG. 10E is a perspective view of one of the rotors in accordance with the present invention, where the dashed line image showing the area of the contact surface having the contour which is generated as a result of the steps shown in FIGS. 10A–10D.

FIGS. 10A–10D, in turn, illustrate the manner in which these calculations are employed to produce a computer generated plot of the contour lines, in FIG. 10E is a partial perspective view of one of the rotors, showing the position of the contour line which has been produced in FIGS. 10A–10D.

The offset distance from the axis O—O out to the working surface is (4 sin δ+t), where s=Rδ. If the tip were to be reshaped to provide a larger radius of curvature at the beginning of contact (for the purpose of reducing wear), the profile of the working surface can still be calculated readily from the existing computer program.

Figure 11A:
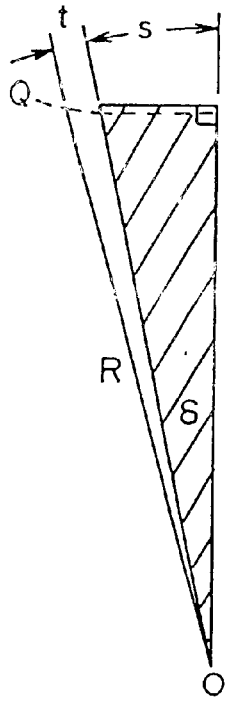
FIG. 11A is a geometric figure, similar to FIG. 8C, showing a revised calculation of the contact surface contours to provide a modified tip-radius form having a slightly flattened shape for enhanced wear characteristics.
Figure 11B:
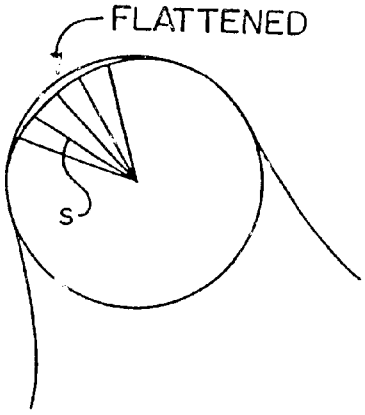
FIG. 11B is a partial, cross-sectional view of the tip portion of a contact surface contour formed in accordance with the relationship shown in FIG. 11A.
Figure 12:
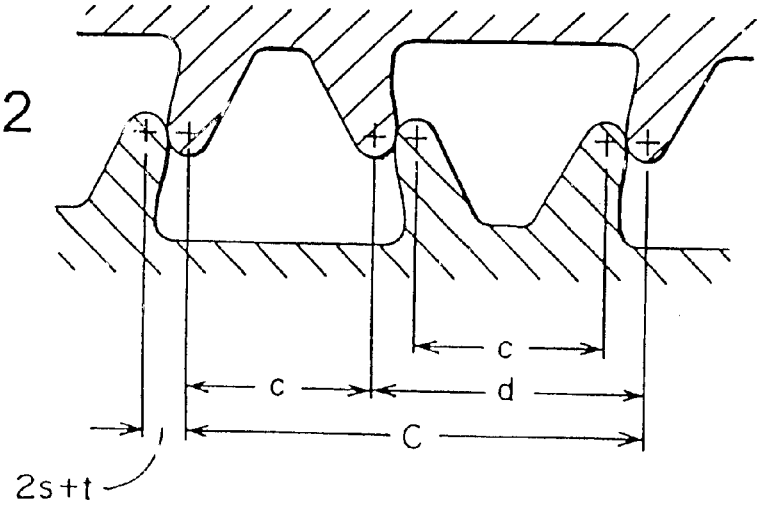
FIG. 12 is a schematic view showing the relationship of a serious of mirror image contact surfaces, somewhat similar to those shown in FIGS. 7A–7C, with these being configured to maintain a predetermined fluid film thickness during operation and also to permit reverse operation of the engine.
Figure 13A:
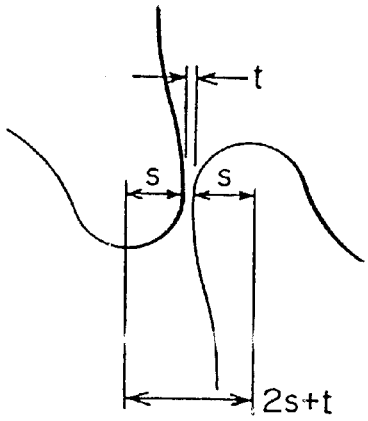
FIG. 13A is a partial, enlarged view of adjacent tip portions of the mirror image contact surfaces of FIG. 12, showing the spacing between the tip surfaces in greater detail.
Figure 13B:
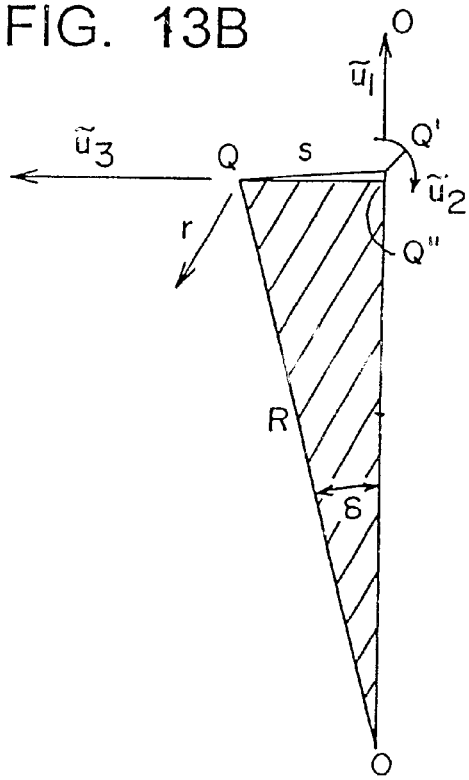
FIG. 13B is a geometric diagram, similar to FIGS. 8C and 11A, illustrating the mathematical determination of the contact surfaces having the clearances which are shown in FIG. 13A.

An approach is as follows, as shown in FIGS. 11A and 11B. Modify the tip radius to make a slightly flattened shape, in the vicinity of where first contact occurs. This shape can be identified as s=s(θ), which means the radius is a function of (depends on) the shaft rotation θ. Once this is selected, the radius can be input as a function of small angular increments, and the profile of the mating working surface calculated for the same fluid thickness t. Actually, fluid thickness may not be constant everywhere. It will probably depend on the relative sliding velocity of the vanes, which increases from zero at the point of contact and increases to a maximum near 90° rotation. The initial flattening of the tip may affect this also.

The working surface would normally follow a radial line towards the center O, resulting in a film thickness that tapers towards the center. The relative sliding velocity between adjacent lobes will be highest at the outside, so a larger thickness of film there seems reasonable. However, for applications where small particulates are contained in the fluid, it may be better to machine the rotor so that a parallel gap is produced. This may prevent material from sticking in the small end of the tapered gap, even though it would tend to be flushed away during the next rotation.

The FIGS. 12, 13A, and 13B, 13*c* show the distance between centers of adjacent tips (measured along the arc of the surface of a sphere of radius R). The arc length C is the distance between like lobe shapes (circular pitch length).

$$c = 2(c = 2s + t) = \frac{2\pi R}{n}$$

where s is the arc length taken up by the tip, t is the film thickness (or net interference) and n is an integer number of pitch lengths to make up a full circle.

If s and t are chosen, $$c = \frac{\pi R - 2s - t}{n}$$

Therefore, the spacing of both c and C are known in terms of the film thickness (negative for interference) and the arc length s. Note that since d=C−c, the center points of the tips of all lobes are not equally spaced and $$d = \frac{\pi R}{n} + 2s + t$$

For input to the computer program, the angle δ=s/R, and the "offset" distance is $$\psi QQ = R \sin \theta$$

Consideration should be given to providing variable spacing, as this would help to alleviate the production of a pure tone noise (having a single frequency component) emanating from the running pump. Variable spacing would produce other frequency components, grouped around the running speed frequency and its harmonics (sidebands). The effect should reduce the overall noise level slightly, but more importantly, be less annoying for personnel in the vicinity.

However, rotor unbalance could be produced for random spacing. If the spacing were arranged symmetrically in pairs, unbalance can be prevented, but the beneficial effect of staggered spacing would be reduced. If the unbalance were the result of a particular arrangement, each rotor could be balanced individually before final assembly. For uniform spacing, whether the number of rotors n is an even or an odd number, balance would be maintained.

d. Geometric Determination of Surface Contours

FIGS. 13–19 illustrate a method for geometric determination of the contact surface contours consistent with the mathematical calculations described above, but which corresponds more directly to an actual manufacturing process for forming the surfaces, as by hobbing material from a blank so as to form the lobes and surfaces.

Two of the main considerations when determining the correct sealing surface gap (SSG) are the "lift off clearance" and the contact characteristic. The "lift off clearance" is the thickness of the fluid film between the sealing surfaces of the two rotors when the engine is operating in its intended mode. "Lift off clearance" is affected by the speed of the engine, the viscosity of the fluid medium, and the differential pressure between the inlet port and the discharge port.

Contact happens when the one or two or all of these factors is insufficient to maintain a fluid film between the mating surfaces. The contact characteristic describes how the sealing surfaces mate when the fluid film is not sufficient to achieve "lift off". The three basic types of contact are (1) Full radial contact, (2) Inner radial contact, and (3) Outer radial contact. These characteristics can be different at different angles of rotor rotation.

Maintaining a fluid film is desirable to reduce wear, as well as to allow entrained particles to pass between the sealing surfaces without damaging the particles or causing excessive abrasion to the sealing surface.

U.S. Pat. No. 5,755,196 describes a CvR™ engine configuration with a "contact" or "close tolerance" seal design which does not optimize or account for the "lift off situation". This type of surface geometry relies on a line to line seal between the rotors and is intended to operate with each rotor sliding on the other rotor without consideration of the fluid film between the rotors. An engine which is designed with this "zero lift off" seal surface will not achieve a consistent fluid film thickness during "lift off" because "lift off" of any type of seal surface in a CvR™ engine does not occur "normal" to the contact surface. "Lift off" happens as the two mating rotors rotate relative to each other around each of their respective axes. As this happens, the gap between the rotors increases more at points which are further from the axis than it does at points which are closer to the center of the rotors.

The radial difference of the surface speed in this contact zone may make up for the variation in gap thickness when the engine is operating at very low pressures. (relative surface speed is greater at points further from the rotational center) But the fluid film "rigidity" is not linear with the thickness of the film which the surface speed is a linear relationship with the distance from center. Ideally then, if surface speed was the only consideration, then the SSG should increase at points further from center, but only enough to establish a consistent fluid film pressure.

As the pressure increases, however, the fluid film is influenced increasingly by the pressurized fluid which is moving past this area. The fluid film resulting from the surface speed is affected greatly by the distance from center and requires an increasing surface gap towards the outside of the engine. The fluid film resulting from the differential pressure between the output port and the input port is independent of the distance from center and requires a more consistent gap clearance. The more the fluid film is affected by the pressure differential of the fluid, the more consistent the radial gap clearance must be to achieve maximum efficiency and wear characteristics.

Consequently the present invention provides methods for determining, defining, and/or constructing this more consistent gap clearance, as well as a method for determining, defining, and/or constructing an engine with a gap clearance that also takes into account the surface speed of each rotor on the other to maximize the "liftoff effect" of the fluid film between the rotors. The methods can also be combined to account for other variables including the change in relative surface speed which occurs at different angular rotor positions.

Optimally, in a CvR™ engine, contact between the sealing surfaces may occur during start-up under high pressure, but should not continue when the engine is operating in its intended mode. In order to achieve "lift off" as soon as possible after start up, and under as high a pressure, and as low a viscosity, and as low a speed as possible, it is desirable to determine and construct a sealing surface with seal surfaces which are more parallel rather than angular interface surfaces which radiate from the spherical center of the pump.

U.S. Pat. No. 5,755,196 describes a surface which is defined by the movement of a cone being rotated around the opposite rotor axis, in which the apex of the cone should be as close to the center of the spherical center of the rotors as possible. The sealing surface of the present invention can also be described with the movement of a cone around the opposite rotor axis, but the cone of this present invention is positioned intentionally above or below the spherical center of the rotors.

By using an off-center cone position, a more parallel seal surface interface can be achieved. This more parallel surface shape will provide a more stable and consistent fluid film between the rotors for reduced wear, and more efficient sealing. In applications where interfering rotor seal interface is desirable, it may even be desirable to produce rotor seal surfaces which interfere more towards the center of the rotors than they do toward the outside of the rotors. The advantage of this design would include better sealing near the center of the pump, and lower friction and less resistance further from center where any resistance will have a greater effect on the operating efficiency of the engine.

To achieve this "angular interface" effect, as well as the "parallel interface" effect, it may also be necessary to introduce a second surface shape variable, which is the angular position of each contact face about the center axis of the pump rotor. By rotating each seal surface relative to the rest of the pump, a predetermined surface interface with specific characteristics can be achieved.

Figure 14:
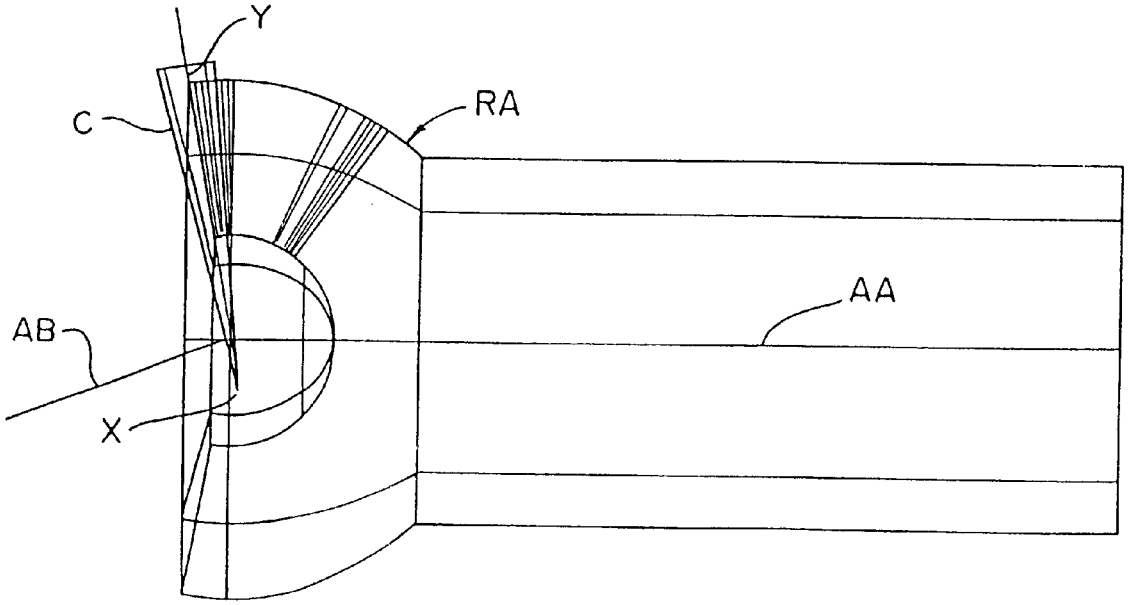
FIG. 14 is an elevational, somewhat diagrammatic view illustrating the determination of the engagement surfaces in accordance with a geometric method which corresponds to the mathematical processes illustrated in FIGS. 8A–13B, in which the gap between the sealing surfaces is controlled by the amount of offset between the apex of a hypothetical cone and the intersection of the axes of the rotors upon which the surfaces are formed.
Figure 15A:
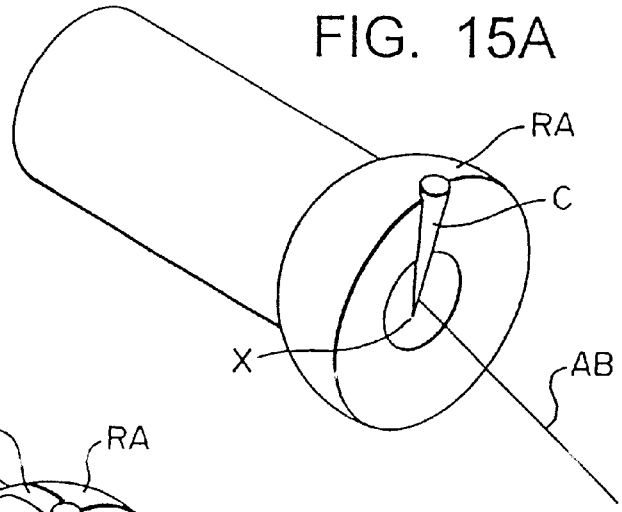
Figure 15B:
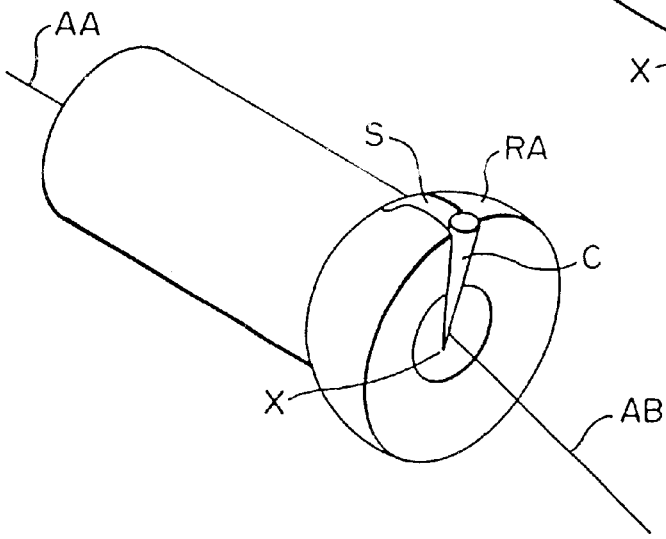
Figure 15C:
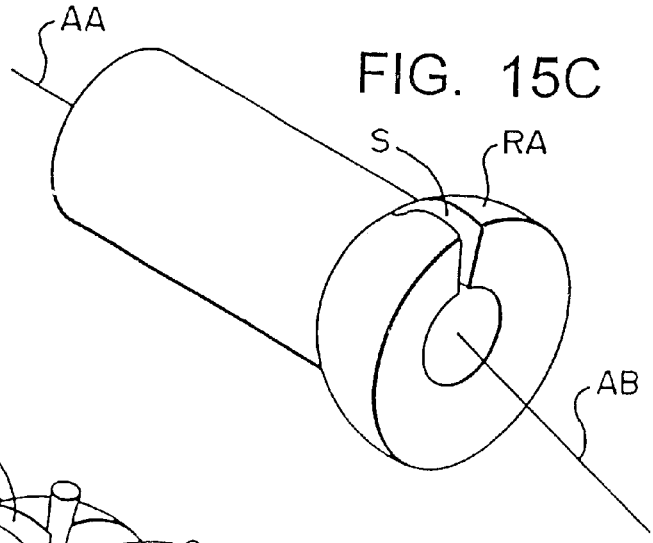
Figure 15D:
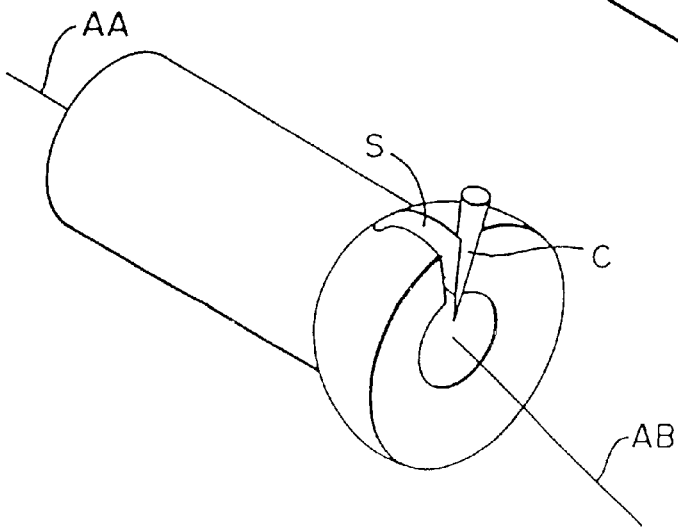

The angular position effect and the off-center cone apex effect will be covered in the following description of how to achieve the desired sealing surface geometry:

Referring now to FIG. 14, a spherical rotor RA is positioned for rotation about its center axis AA. A second axis AB is positioned at an angle X to axis AA. A cone C is positioned with its center axis collinear with a line Y that bisects the obtuse angle between axis AA and axis AB.

If a positive parallel SSG is desired, the cone C is positioned on line Y with its apex X below the point P where the two rotor axes intersect.

If a negative parallel SSG is desired, the apex of the cone must be positioned above the point P. (The smaller the angle of the cone, the more its apex must be positioned off center to achieve a given gap clearance or interference.)

As is shown in FIGS. 15A–E, the spherical rotor and the cone are then rotated around their respective axes (i.e., cone C rotates on axis AB at a fixed angle thereto) and the path of the cone is removed from the spherical rotor. This will define the "seal surface" S of one side of one vane $V_1$ on the rotor RA.

The rotor is then rotated toward the first cone and another cone shape C is positioned with its axis collinear with the line Y. This cone has the same angle as the first cone and it is positioned with its apex the same distance from center but on the opposite side of point P (see FIG. 15). This cone is added to the rotor RA and becomes the "seal tip" T of this seal face, as is shown in FIG. 15E. The sequence is then repeated for the second rotor RB (See FIGS. 16A–16B) with a cone which is positioned along the center axis of the adjacent "seal tip" T cone of the rotor RA.

Figure 16B:
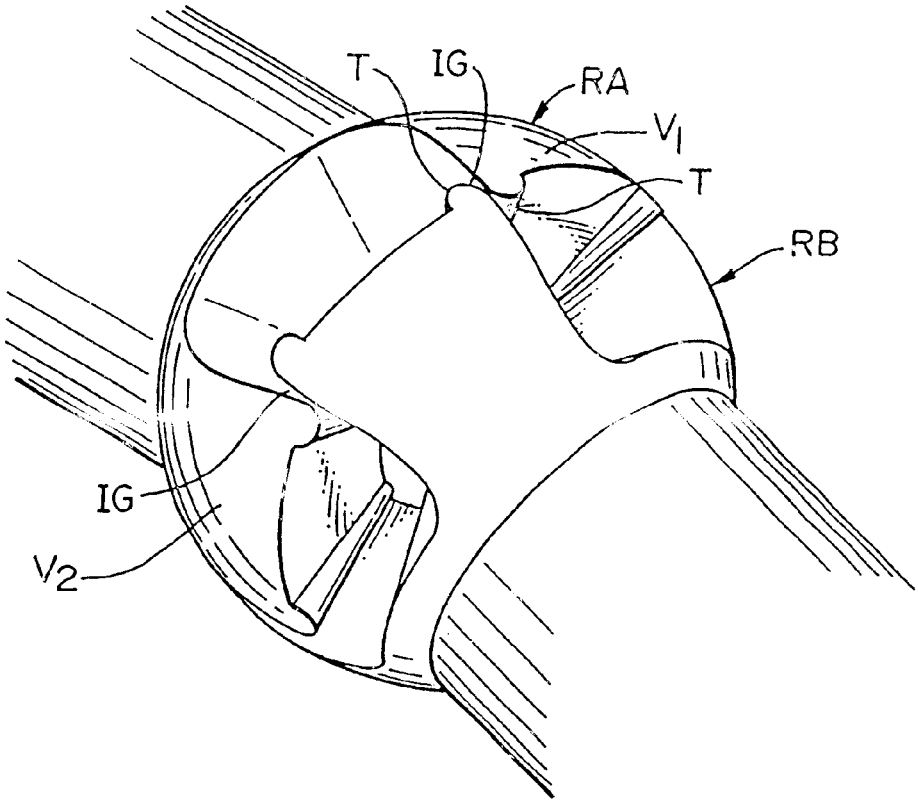

Once this sequence is repeated for each side of each vane, the engine will have a predetermined parallel interface gap IG between mating surfaces as is shown most clearly in FIG. 16B.

Another gap configuration which can be used on its own or in combination with the "offset cone" gap configuration, is the "angular interfacial gap".

Figure 17:
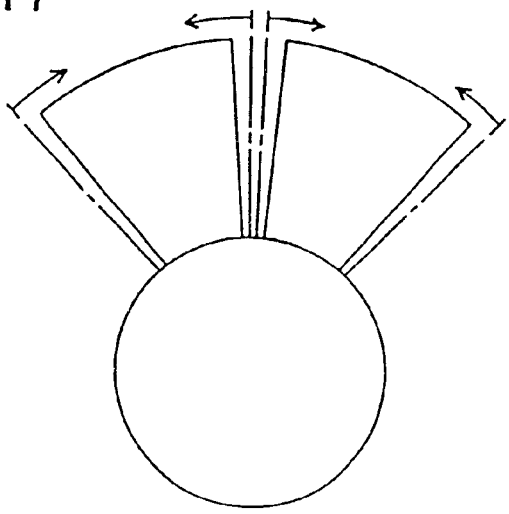
FIG. 17 is a schematic, end view of adjacent sealing surfaces such as those which are shown in FIGS. 16A–16B, illustrating the manner in which the gap between the sealing surfaces is increased or decreased by rotation of the rotor relative to the hypothetical cone which is shown in FIGS. 14–15F.
Figure 18:
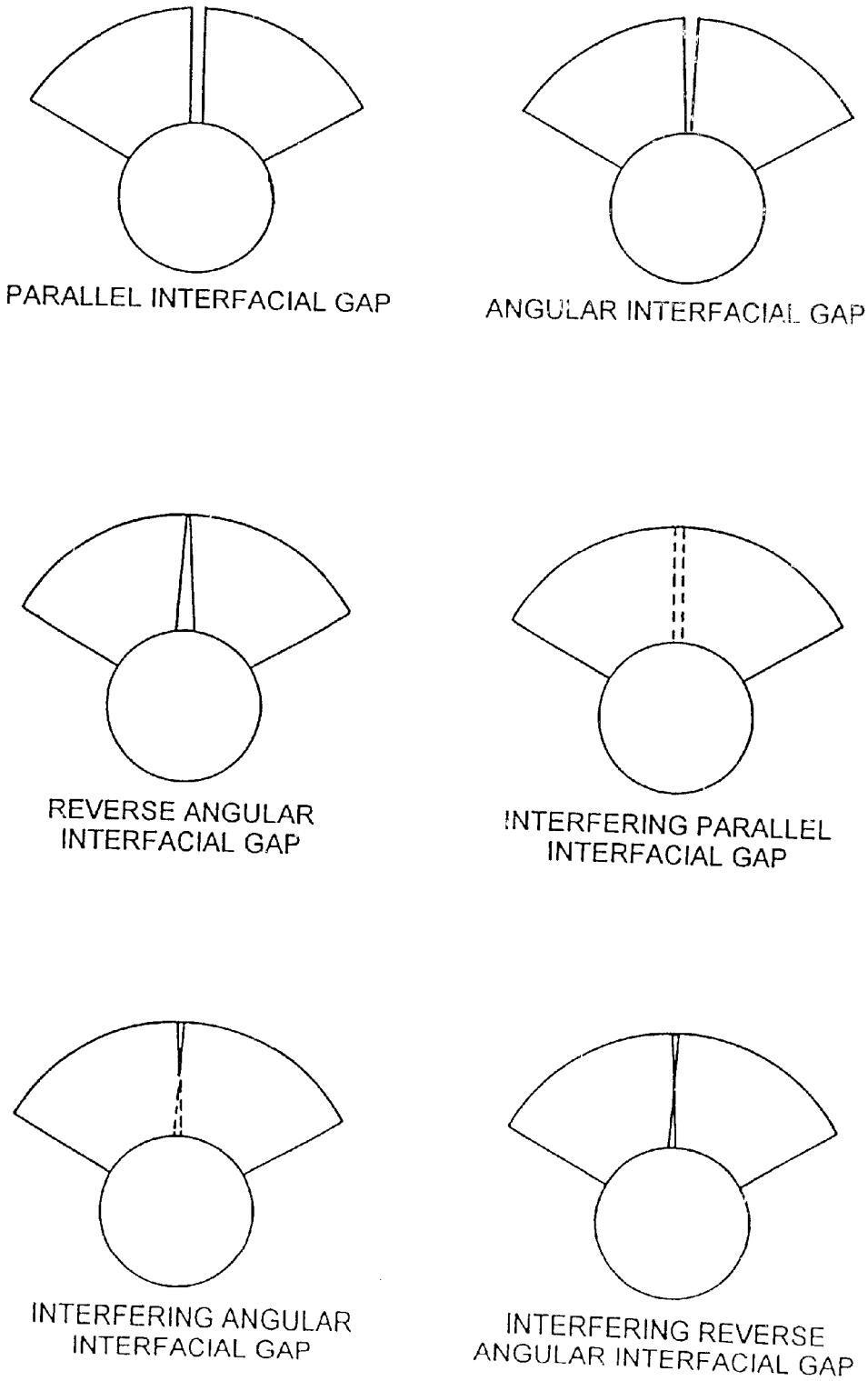
FIG. 18 shows a series of schematic views similar to FIG. 17, showing the different forms of parallel and angular interfacial gaps which can be formed between the sealing surfaces by adjusting variable factors in the methods which are illustrated in FIGS. 14–15F.

This type of gap (or interference) is achieved by rotating each seal surface around the center of its rotor's axis relative to the seal surface on the opposite side of the vane it is on as is shown in FIG. 17. Comparative examples of positive and negative "angular" and "parallel" interfacial gaps are shown in FIG. 18.

An angular interfacial gap may offer performance benefits for certain applications. For example, the centrifugal force of the rotation of the engine could be used to force particulate matter entrained in the fluid to the periphery of the engine chamber. In this case an angular interfacial gap with a larger gap at the periphery of the rotors would allow the particles to pass through the thicker fluid film, while a more efficient seal could be maintained closer to the center of the rotors where the fluid film is thinner.

A characteristic of the "parallel interfacial gap" compared to the "angular interfacial gap" is that the "parallel interfacial gap" method creates a consistent SSG for the entire seal surface. The "angular IG" method (of rotating the seal surface relative to the rest of its rotor), only changes the gap clearance in a plane that is perpendicular to the rotational axis of the rotor.

This is desirable for applications where a reduced gap clearance is beneficial during specific areas of the seal surface interface. Shear sensitive or highly viscous fluids, for example, might be damaged or cause excessive friction if a minimal gap were maintained for the entire rotation of the rotors. In this case, a smaller gap can be achieved during the sealed portion of the rotation at the bottom of the rotation while a larger gap will be more desirable during the unsealed portion of the rotation.

Figure 20:
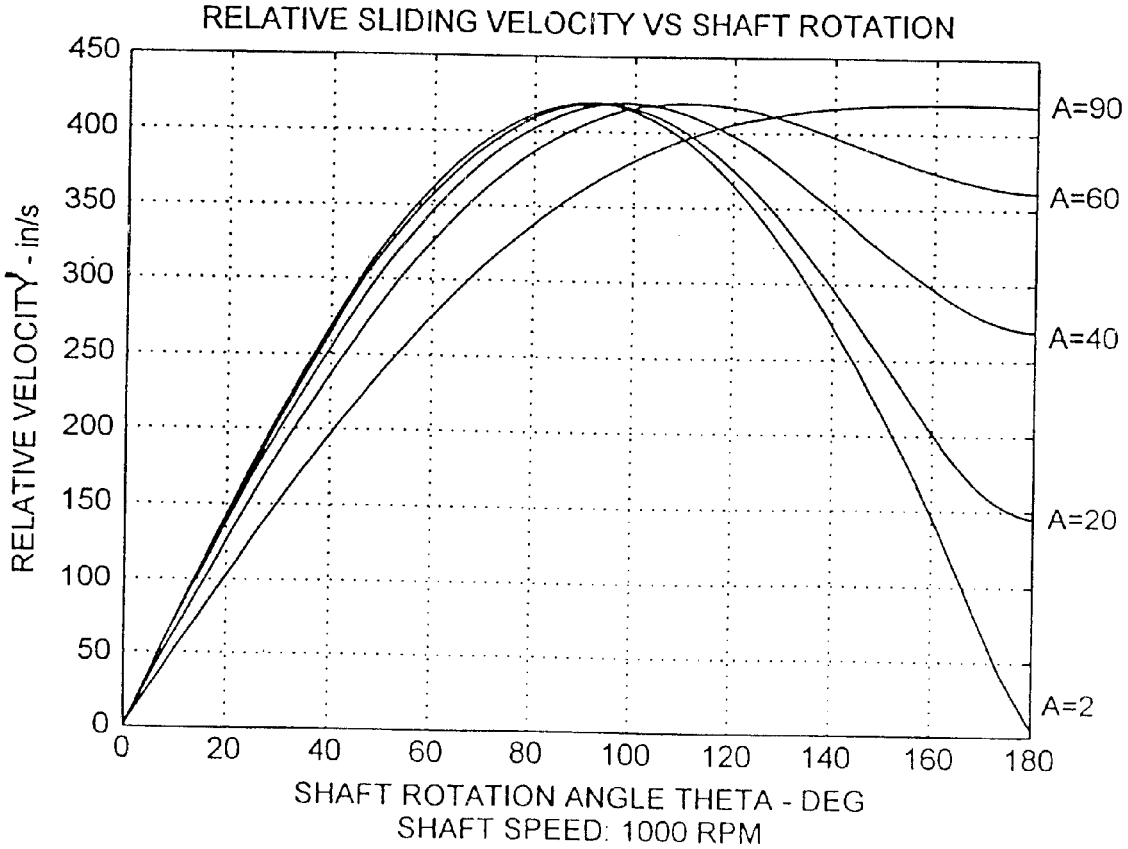
FIG. 20 is a chart demonstrating the relationship between the relative sliding velocity of the sealing surfaces of an engine in accordance with the present invention, as a function of shaft velocity.

Further benefit can be realized in this regard if the relative speed of the rotors is taken into account (see FIG. 20). The sealed part of the rotation at the top and bottom of the casing corresponds with the lowest relative speed of the interjacent rotation of the rotors.

As the seal tip of each vane nears BDC the surface speed reduces. A reduced gap clearance can be achieved in this area using the Angular IG method or a combination of the Angular IG method and the Parallel IG method of changing the gap at the higher relative speed areas of the seal surface.

At TDC the surface speed also reduces, but the angular IG method will increase this gap. To increase the gap clearance at some places but not at TDC, it is necessary to use the Parallel IG method of achieving the desired gap, but the cone must be moved dynamically along its axis as the rotors are rotated during the shaping process.

In essence, as one rotor rotates from each contact extreme, relative to the other rotor, the transitional gap between the rotors changes from an angular interfacial gap to a parallel interfacial gap and on to an angular interfacial gap at an angle in opposition to the initial angular interfacial gap. Some transitional gaps will be a variation of the above description in that they will incorporate only one or two of these descriptions.

Although the cone shape described above is the ideal shape, and the simplest to calculate and design, it will be understood that other similar shapes (such as a portion of a much larger cone or simply a sharp edge) could be used, however, as the mating surface is designed to maintain the desired SSG as both rotors spin at the same speed.

Furthermore, it will be understood that, while the description of the method of the present invention has been described herein with regard to externally contoured vanes/lobes, the method is equally applicable to CvR engines having pistons or corresponding structures which are house or retained within the lobes, such as the piston-engine structure which is shown in FIG. 16 of the above-referenced U.S. patent.

e. Verification of Contours

Many methods for verifying the surface shape are available. A contact CMM machine, for example, could be used to determine a number of points on the surface of a completed rotor, and establish what the seal surface characteristic is. The most basic way of determining if a rotor design has been manufactured according to the present invention is to create a plane which is perpendicular to a point on the seal face (or seal tip) which passes through the spherical center of the sphere. Two points on the seal face or seal tip surface which are also on this plane will be connected and extended toward the spherical center of the engine.

A rotor face with a parallel interfacial gap will result in the extended line passing consistently to the contact surface lobe side of the spherical center.

A rotor face with an angular interfacial gap may result in the extended line passing through the spherical center of the rotors or on either side, depending on the angle, and on the magnitude of the gap. For most applications, however, the extended line of an angular interfacial gap will pass through the spherical center or to the side of the spherical center which is away from the mass of the seal surface lobe.

A rotor face with a reverse angular interfacial gap will result in the extended line passing consistently on the side of the spherical center which is away from the mass of the seal surface lobe.

A rotor face with an interfering parallel interfacial gap will result in the extended line passing consistently on the side of the spherical center which is away from the mass of the seal surface lobe.

A rotor face with an interfering angular interfacial gap will also result in the extended line passing consistently on the side of the spherical center which is away from the mass of the seal surface lobe.

A rotor face with an interfering reverse angular interfacial gap will result in the extended line passing consistently on the side of the spherical center which is toward the mass of the seal surface lobe.

By checking the surfaces in this way, it is possible to verify the sealing and fluid film characteristics of a particular engine design.

f. Interrupted Seal

Figure 19A:
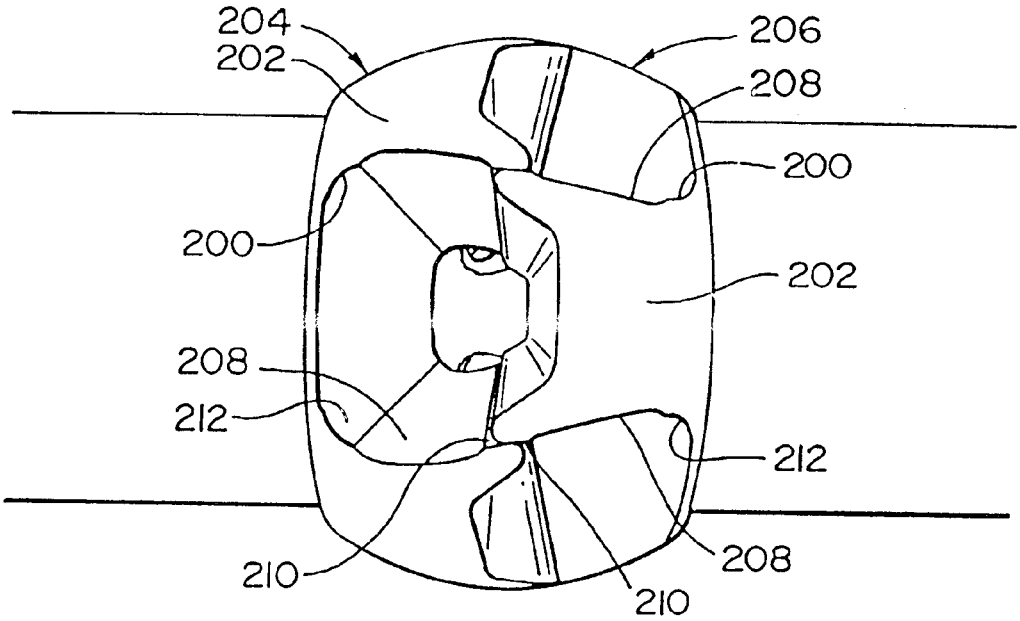
FIGS. 19A–19C are a series of perspective, somewhat schematic views of a rotor assembly in accordance with an embodiment of the present invention in which relief areas are formed in the sides of the sealing surfaces between the upper and lower ends thereof so as to reduce wear and provide enhanced characteristics for certain applications.
Figure 19B:
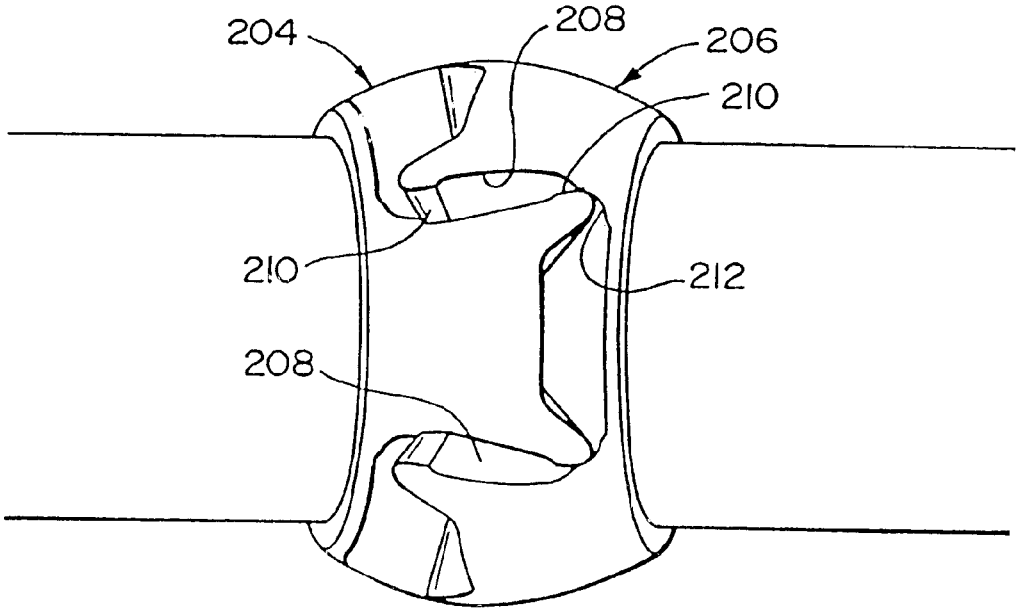
Figure 19C:
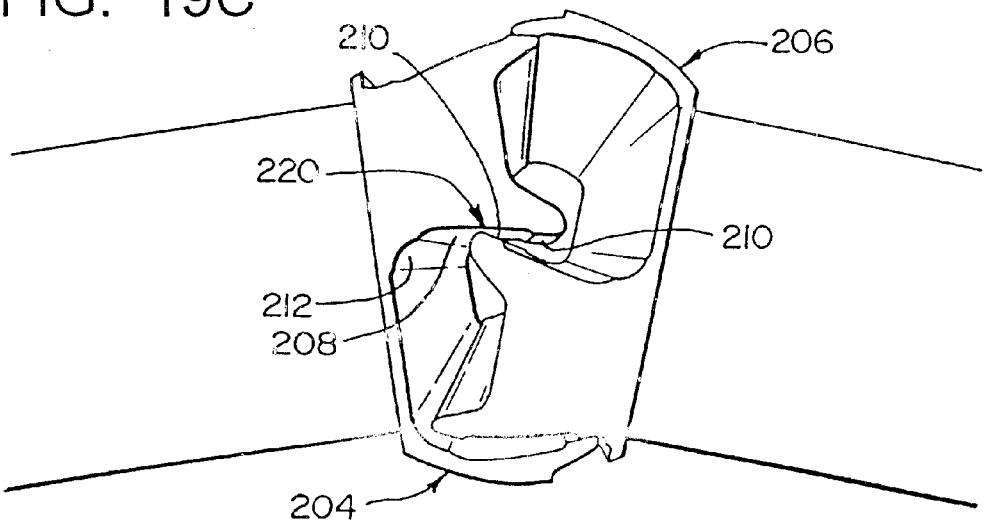

FIGS. 19A–19C illustrate in the embodiment of the present invention in which the sealing surfaces are shaped so as to provide actual fluid sealing during only selected portions of the rotation of the assembly, i.e., at those points during the rotation where the seal is required in order to maintain efficiency. This configuration is advantageous in a number of applications, including for use with pumping sheer sensitive or abrasive fluids, and for enhanced wear characteristics.

Accordingly, as can be seen, in the embodiment which is illustrated in FIGS. 19A–19C, the sealing surfaces 200 on the vanes 202 of the two rotors 204, 206 are each formed with a recess or channel area 208 which extends radially across the rotor base and separates the sealing surface segments 210, 212 which lie proximate the tip and at base portions of the contoured face.

The sealing surface segments 210, 212 are formed in accordance with the methods described above, i.e., these are configured to form the requisite seal with the corresponding segments on the adjoining contoured face, with a predetermined gap as desired. Since the sealing segments are formed at the top and bottom of each surface, the rotors form an effective seal only when the chambers defined thereby are approximately at top and bottom dead center, as is shown in FIGS. 19A and 19B.

At points in the cycle between top and bottom dead center, however, the channels 208 eliminate direct contact between the two sealing surfaces so as to form a relief gap 220, as is shown in FIG. 19C. The relief gap reduces sheer stresses on fluid in this area, and also allows particulate or abrasive material to pass therethrough without causing wear against the sealing surfaces. Furthermore, the relief gap reduces wear by eliminating a potential content between the sealing surfaces during the intermediate phases of the engine cycle, even in applications not being used with abrasive fluids. Since sealing is only critical when the chambers are at top and bottom dead center, these advantages are achieved without significant cost to the overall efficiency of the engine.

It is to be recognized that these and various other alterations, modifications, and/or additions may be introduced into the constructions and arrangements of parts described above without departing from the spirit or ambit of the present invention as defined by the appended claims.

What is claimed is:

1. A method for determining contoured contact faces for a rotor of an engine so as to provide a predetermined gap between said faces, said method comprising the steps of:

providing a first rotor for being mounted on a housing for rotation about a first axis in engagement with a second rotor which is mounted on said housing for rotation about a second axis which is offset from being collinear by an angle $\alpha$ and which intersects said first axis at a common center of said rotors;

defining a cone which is in contact with said first rotor and which has an apex and an axis which bisects the obtuse angle between said first and second axes of said rotors;

positioning said apex of said cone at a spaced distance from said intersection of said axes of said rotors which corresponds to said predetermined gap between said contoured contact faces of said rotors; and rotating said first rotor about said first axis and said cone about said second axis so as to remove material from said first rotor so as to form said contoured contact surface thereon.

2. The method of claim 1, wherein said apex of said cone is positioned below said intersection to form a positive gap between said contoured surfaces.

3. The method of claim 2, wherein said apex of said cone is positioned above said intersection to form a negative gap between said contoured surfaces.

4. The method of claim 1, further comprising the step of:

initially rotating said first rotor about said first axis relative to said cone so a to form a predetermined angled gap between said contoured faces.

5. The method of claim 4, wherein the step of initially rotating said first rotor relative to said cone comprises:

rotating said first rotor relative to said cone in a direction which is selected to form a gap which is angled so a to increase in width radially away from said common center of said rotors.

6. The method of claim 4, wherein the step of initially rotating said first rotor relative to said cone comprises:

rotating said first rotor relative to said cone in a direction which is selected to form a gap which is angled so as to increase in width radially inwards towards said common center of said rotors.

7. A method of creating an engine, comprising the steps of:

mounting a first rotor mounted for rotation in a housing about a first axis, said first rotor including first and second opposite facing contoured faces and a surface defining at least part of a sphere having a center;

mounting a second rotor mounted for rotation in said housing about a second axis said second rotor including third and fourth contoured faces and a surface defining at least part of a sphere having a common center with said center of said first rotor;

aligning the first axis and second axis being offset from being collinear by an angle $\alpha$ and intersecting at the common centers of the rotors;

constructing each contour face of each rotor being defined by the locus formed as the rotors rotate about their respective axes by points on the other rotor whereas the points of each rotor that define the locus lying along an outer edge of a cone whose central axis is essentially a radius extending outward from the common centers of the rotor at an angle $\alpha/2$ from a normal to the axis of the other rotor; said first and second contoured faces being similar and said third and fourth contoured faces being similar and said first and third contoured faces being arranged in face-to-face engagement;

whereas said engagement of said mirror image contoured faces prevents backlash between said rotors so as to maintain a predetermined gap between said faces during operation of said engine.

8. The method of claim 7 in which the first and second rotors face each other axially across the common center of the rotors, and the first rotor is a master rotor and the second rotor is a slave rotor.

9. The method of claim 7 in which the housing has an interior surface defining at least a partially spherical cavity, whose center coincides with the common center of the rotors and the housing interior surface cooperates with the contoured faces of the rotors to form the chambers.

10. A method of constructing a device to convert energy comprising the steps of mounting the first rotor on a first axis of rotation where a second axis intersects the first axis at the centerpoint of the first rotor where a central axis that is a radius extending outward from the centerpoint is equidistant from the first and second axis and a cone about the central axis is rotated about the second axis while simultaneously rotating the first rotor in a first direction at the same angular rate as the central axis towards the same direction whereby the cone defines material to be removed and in removing such material a first contour surface is formed, constructing a second surface on the first rotor where the second contour surface is formed by first indexing the first rotor in first direction and then rotating the central axis about the second axis in the opposite direction of the first direction used to form the first contour surface whereby simultaneously rotating the first rotor at the same angular rate as the central axis whereby the cone defines material to be removed and in removing such material a second contour surface is formed, positioning first and second tips on a second rotor that is adapted to rotate about the second axis and the first and second tips are adapted to engage the first and second contour surfaces respectively where the central axis of the first tip is positioned in the substantially same location as the center axis when defining material to be removed for the first contour surface and the central axis of the second tip is positioned in the substantially same location as the center axis when defining material to be removed for the second contour surface whereas the first and second rotors are positioned in a housing adapted to allow fluid to pass through ports of the housing and enter chambers formed in part by the first and second surfaces where the change in volume of the chambers is adapted to create a change in volume of the fluid.

11. The method as recited in claim 10 further comprising the steps of mounting the second rotor on the second axis of rotation where the first axis intersects the second axis at the centerpoint of the second rotor where a central axis that is a radius extending outward from the centerpoint of the second rotor is equidistant from the first and second axis and a cone about the central axis is rotated about the second axis while simultaneously rotating the second rotor in a second direction at the same angular rate as the central axis towards the same direction whereby the cone defines material to be removed and in removing such material a third contour surface is formed, constructing a fourth surface on the second rotor where the fourth contour surface is formed by first indexing the second rotor in first direction and then rotating the central axis about the second axis in the opposite direction of the second direction used to form the third contour surface whereby simultaneously rotating the second rotor at the same angular rate as the central axis whereby the cone defines material to be removed and in removing such material a fourth contour surface is formed, positioning third and fourth tips on a first rotor that is adapted to rotate about the first axis and the third and fourth tips are adapted to engage the third and fourth contour surfaces respectively where the central axis of the third tip is positioned in the substantially same location as the center axis when defining material to be removed for the third contour surface and the central axis of the fourth tip is positioned in the substantially same location as the center axis when defining material to be removed for the fourth contour surface.

12. The method as recited in claim 11 where the surface of first and second tips are continuous with the third and fourth contour surfaces respectfully.

13. The method as recited in claim 12 where the surface of third and fourth tips are continuous with the first and second contour surfaces respectfully.

14. The method as recited in claim 12 where by the third and fourth surfaces define a region that is adapted to accept the first and second surfaces that in part define a lobe where as when the first and second rotors are rotated the lobe of the first rotor engages the region between the third and fourth surfaces.

15. The method as recited in claim 14 where the third and forth surfaces partially form third and fourth lobes respectfully of the second rotor.

* * * * *